US011346561B2

(12) United States Patent
Ryu et al.

(10) Patent No.: US 11,346,561 B2
(45) Date of Patent: May 31, 2022

(54) OVEN

(71) Applicant: Samsung Electronics Co., Ltd., Suwon-si (KR)

(72) Inventors: Ji Won Ryu, Suwon-si (KR); Jea Won Lee, Suwon-si (KR); Wan-Ku Kang, Suwon-si (KR); Young Mi Kim, Suwon-si (KR); Hyun Uk Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/733,304

(22) PCT Filed: Dec. 18, 2018

(86) PCT No.: PCT/KR2018/016149
§ 371 (c)(1),
(2) Date: Jun. 22, 2020

(87) PCT Pub. No.: WO2019/124944
PCT Pub. Date: Jun. 27, 2019

(65) Prior Publication Data

US 2020/0386414 A1 Dec. 10, 2020

(30) Foreign Application Priority Data

Dec. 21, 2017 (KR) ..... 10-2017-0176882

(51) Int. Cl.
*F24C 15/16* (2006.01)
*E05F 1/12* (2006.01)
*F24C 15/02* (2006.01)

(52) U.S. Cl.
CPC ..... *F24C 15/162* (2013.01); *E05F 1/1284* (2013.01); *F24C 15/16* (2013.01); *E05Y 2900/308* (2013.01); *F24C 15/02* (2013.01)

(58) Field of Classification Search
CPC ..... E05F 1/1284; E05Y 2900/308; F24C 15/162; F24C 15/023; F24C 15/02; F24C 15/028; F24C 15/16
See application file for complete search history.

(56) References Cited

U.S. PATENT DOCUMENTS 1,851,854 A * 3/1932 Lindemann ..... F24C 15/162 126/340
1,960,365 A * 5/1934 Barker ..... F24C 15/16 312/400

(Continued)

FOREIGN PATENT DOCUMENTS

JP H11-287458 A 10/1999
JP 2006-207873 A 8/2006

(Continued)

OTHER PUBLICATIONS

International Search Report and Written Opinion of the International Searching Authority in connection with International Application No. PCT/KR2018/016149 dated Apr. 19, 2019, 10 pages.

(Continued)

*Primary Examiner* — Alfred Basichas

(57) ABSTRACT

The present disclosure relates to an oven having a guide member capable of automatically withdrawing an oven rack from the inside of a cooking chamber when a door is opened and a rail detachably coupled to the cooking chamber and the oven rack to move the oven rack in the front-rear direction. The oven includes a main body, a cooking chamber provided inside the main body and having an open front side, a door rotatably coupled to the main body to open and close the cooking chamber, an oven rack provided inside the cooking chamber to be movable in the front-rear direction and supporting a plurality of shelves, and a guide member connected to the oven rack according to opening and closing of the door to guide the oven rack to be moved in the (Continued)

front-rear direction, and separated from the oven rack when the door is completely opened.

14 Claims, 23 Drawing Sheets

(56) References Cited

U.S. PATENT DOCUMENTS 1,970,343 A * 8/1934 Sherman ..... F24C 15/162 126/340
2,049,237 A * 7/1936 Wertzheiser ..... F24C 15/162 126/340
2,088,719 A * 8/1937 Pierson ..... F24C 15/162 312/269
2,095,811 A * 10/1937 Goulooze ..... F25D 25/024 312/274
2,132,737 A * 10/1938 Kahn ..... F24C 15/162 126/340
2,296,950 A * 9/1942 Roedl ..... F24C 15/162 312/269
2,649,085 A * 8/1953 Hurt ..... F24C 15/023 126/41 D
2005/0205081 A1* 9/2005 Barker ..... F24C 15/162 126/190
2014/0035452 A1* 2/2014 Nickelson ..... F24C 15/162 312/309

FOREIGN PATENT DOCUMENTS

KR 10-1999-0057023 A 7/1999
KR 10-0818910 B1 4/2008
KR 10-1055737 B1 8/2011

OTHER PUBLICATIONS

Korean Intellectual Property Office, "Notice of Preliminary Rejection" dated Oct. 13, 2021, in connection with Korean Patent Application No. 10-2017-0176882, 12 pages.
Notice of Preliminary Rejection dated Apr. 13, 2022, in connection with Korean Application No. 10-2017-0176882, 4 pages.

* cited by examiner

OVEN

CROSS-REFERENCE TO RELATED APPLICATIONS

This application is a 371 National Stage of International Application No. PCT/KR2018/016149, filed Dec. 18, 2018, which claims priority to Korean Patent Application No. 10-2017-0176882, filed Dec. 21, 2017, the disclosures of which are herein incorporated by reference in their entirety.

BACKGROUND

1. Field

The present disclosure relates to an oven having a guide member capable of automatically withdrawing an oven rack according to opening and closing of a door.

2. Description of Related Art

An oven is an apparatus that cooks food by sealing and heating food, and may generally be classified into an electric type, a gas type, and an electronic type according to a heat source.

Electric ovens use electric heaters as a heat source, and gas ovens and microwave ovens use heat of gas and frictional heat of water molecules due to high frequencies as heat sources, respectively.

The oven may include a main body forming an outer appearance, a cooking chamber provided inside the main body and having an open front side, and a door rotatably coupled to the main body to open and close the cooking chamber.

A plurality of shelves on which food or the like for cooking is placed is provided inside the cooking chamber, and the plurality of shelves is supported by oven racks.

Because a user needs to open the door and put his or her hand into the cooking chamber that is kept at a high temperature in order to take out food or the like, which has been cooked, the user may feel discomfort due to exposure to the high temperature.

SUMMARY

The present disclosure is directed to providing an oven having a guide member capable of automatically withdrawing an oven rack from the inside of a cooking chamber when a door is opened.

Further, the present disclosure is directed to providing an oven in which a rail for moving an oven rack in the front-rear direction is detachably coupled to a cooking chamber and the oven rack.

One aspect of the present disclosure provides an oven including a main body, a cooking chamber provided inside the main body and having an open front side, a door rotatably coupled to the main body to open and close the cooking chamber, an oven rack provided inside the cooking chamber to be movable in the front-rear direction and supporting a plurality of shelves, and a guide member connected to the oven rack according to opening and closing of the door to guide the oven rack to be moved in the front-rear direction, and separated from the oven rack when the door is completely opened.

The guide member may be provided in a pair to be coupled to each of the left and right sides of a rear surface of the door, and the oven rack provided on each of opposite sides of the cooking chamber may include a pair of connection protrusions protruding toward the pair of guide members to be connected to the pair of guide members.

The guide member may be configured such that one side thereof toward the connection protrusion is opened.

The guide member may include an opening through which the connection protrusion, which is moved in the front-rear direction together with the oven rack, is introduced into and withdrawn from the guide member.

The guide member may further include a guide slot guiding the connection protrusion such that the oven rack is moved in the front-rear direction, and a plurality of guide walls forming the guide slot.

The guide slot may include a first guide slot guiding the connection protrusion introduced into the opening to move the oven rack toward the front, and a second guide slot connected to the first guide slot and guiding the connection protrusion to be withdrawn to the opening.

The guide member may include an introducing portion connecting the opening to the first guide slot to allow the connection protrusion to be introduced into the first guide slot, and a withdrawing portion connecting the opening to the second guide slot to allow the connection protrusion to be withdrawn to the opening.

The guide wall may include a first guide wall in which the connection protrusion is positioned in a state where the door is closed, a second guide wall guiding the connection protrusion moving along the first guide slot such that the oven rack moves toward the front when the door is opened, and a third guide wall guiding the connection protrusion to be withdrawn to the opening when the door is completely opened.

The guide member may include an opening and closing member to open and close the introducing portion, and the opening and closing member may be provided as an elastic member.

The opening and closing member may open the introducing portion such that the connection protrusion is introduced into the introducing portion when the door is closed, and may close the introducing portion when the connection protrusion is introduced into the introducing portion.

A rail allowing the oven rack to be moved in the front-rear direction may be detachably coupled to a lower portion of the oven rack, and the rail may be detachably coupled to the inside of the cooking chamber.

The rail may include a plurality of bosses coupled to the cooking chamber, and the cooking chamber may include a plurality of coupling grooves to which the plurality of bosses is detachably coupled.

The oven rack may be moved in the front-rear direction by a rail including a first rail coupled to a lower portion of the oven rack and a second rail coupled to the inside of the cooking chamber to guide the first rail to be moved in the front-rear direction, and a withdrawal assist device may be provided on the rail to additionally withdraw the oven rack withdrawn when the door is opened.

The withdrawal assist device may include a case fixed to the second rail, a stator moving linearly inside the case and having a locking protrusion, a guide rail guiding the locking protrusion, a locking groove provided at the rear of the guide rail to lock the locking protrusion, a spring accumulating an elastic force when the door is closed and applying the elastic force in a direction in which the oven rack is withdrawn when the door is opened, and a trigger provided on the first rail to be moved in the front-rear direction such that the locking protrusion is released from the locking groove.

When the oven rack is withdrawn by opening the door, the trigger may be moved forward so that the locking protrusion is released from the locking groove, the locking protrusion may be moved forward along the guide rail by being released from the locking groove, and when the stator to which one side of the spring is connected is moved forward together with the trigger, the oven rack may be additionally withdrawn by the first rail moved forward together with the trigger.

Another aspect of the present disclosure provides an oven including a main body, a cooking chamber provided inside the main body and having an open front side, a door rotatably coupled to the main body to open and close the cooking chamber, an oven rack provided inside the cooking chamber to be movable in the front-rear direction and supporting a plurality of shelves, a rail including a first rail coupled to a lower portion of the oven rack and a second rail coupled to the inside of the cooking chamber to guide the first rail to be moved in the front-rear direction, a guide member connected to the oven rack according to opening and closing of the door to guide the oven rack to be moved in the front-rear direction, and a withdrawal assist device provided on the rail to additionally withdraw the oven rack withdrawn when the door is opened.

The oven rack may include a connection protrusion connected to the guide member according to opening and closing of the door, and the guide member may include an opening through which the connection protrusion is introduced into and withdrawn from the guide member, a guide slot guiding the connection protrusion such that the oven rack is moved in the front-rear direction, and a plurality of guide walls forming the guide slot.

The connection protrusion may be connected to the guide member in a state where the door is completely closed, guided by the guide slot in a process of opening the door so that the oven rack is withdrawn from the cooking chamber, and withdrawn to the outside of the guide member through the opening when the door is completely opened so that the oven rack is separated from the guide member.

Another aspect of the present disclosure provides an oven including a main body, a cooking chamber provided inside the main body and having an open front side, a door rotatably coupled to the main body to open and close the cooking chamber, an oven rack provided to support a plurality of shelves and to be moved in the front-rear direction inside the cooking chamber and having a connection protrusion, and a guide member connected to the door and guiding the oven rack to be moved in the front-rear direction according to opening and closing of the door, wherein the guide member includes an opening through which the connection protrusion is introduced into and withdrawn from the guide member according to opening and closing of the door, and a guide slot guiding the connection protrusion such that the oven rack is moved in the front-rear direction.

The connection protrusion may be separated from the guide member through the opening when the door is completely opened and connected to the guide member through the opening when the door is closed.

According to embodiments of the present disclosure, ease of use may be improved by being less exposed to high temperature heat.

In addition, an oven rack may be detachably coupled to the inside of a cooking chamber to facilitate cleaning of the oven rack.

DETAILED DESCRIPTION

Figure 1:
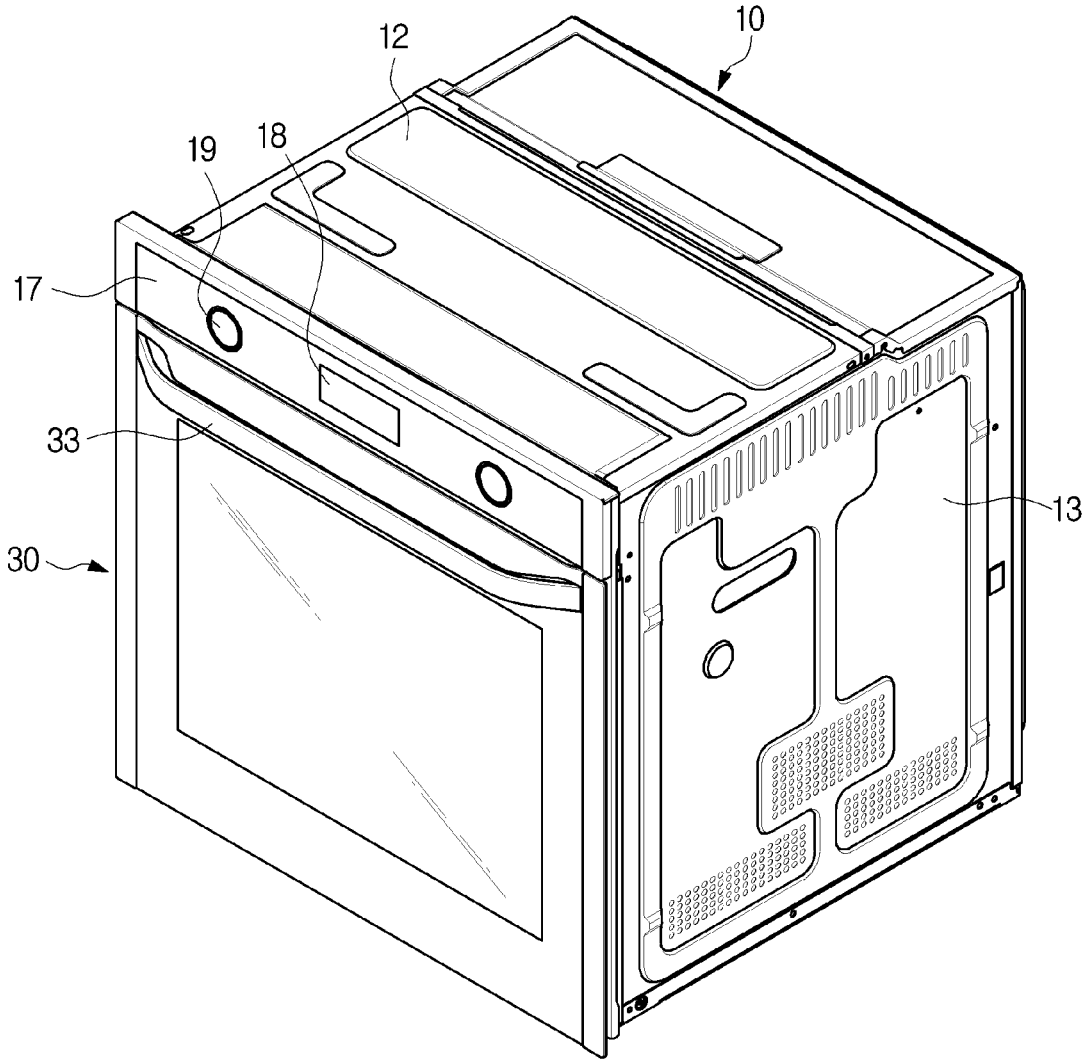
FIG. 1 is a perspective view of an oven according to an embodiment of the present disclosure.

The embodiments described in the present specification and the configurations shown in the drawings are only examples of preferred embodiments of the present disclosure, and various modifications may be made at the time of filing of the present disclosure to replace the embodiments and drawings of the present specification.

Like reference numbers or signs in the various drawings of the application represent parts or components that perform substantially the same functions.

The terms used herein are for the purpose of describing the embodiments and are not intended to restrict and/or to limit the present disclosure. For example, the singular expressions herein may include plural expressions, unless the context clearly dictates otherwise. Also, the terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that, although the terms first, second, etc. may be used herein to describe various components, these components should not be limited by these terms. These terms are only used to distinguish one component from another. For example, without departing from the scope of the present disclosure, the first component may be referred to as a second component, and similarly, the second component may also be referred to as a first component. The term "and/or" includes any combination of a plurality of related items or any one of a plurality of related items.

In this specification, the terms "front end," "rear end," "upper portion," "lower portion," "upper end" and "lower end" used in the following description are defined with reference to the drawings, and the shape and position of each component are not limited by these terms.

Hereinafter, embodiments of the present disclosure will be described in detail with reference to the accompanying drawings.

In the following description, the expressions 'front' and 'front side' refer to a direction in which the door is provided based on a main body of an oven, and the expressions 'rear' and 'rear side' refer to a direction opposite to the direction in which the door is provided based on the main body of the oven.

In addition, the expression 'upper' refers to an upper direction based on the main body of the oven, and the expression 'lower' refers to a lower direction based on the main body of the oven.

Figure 2:
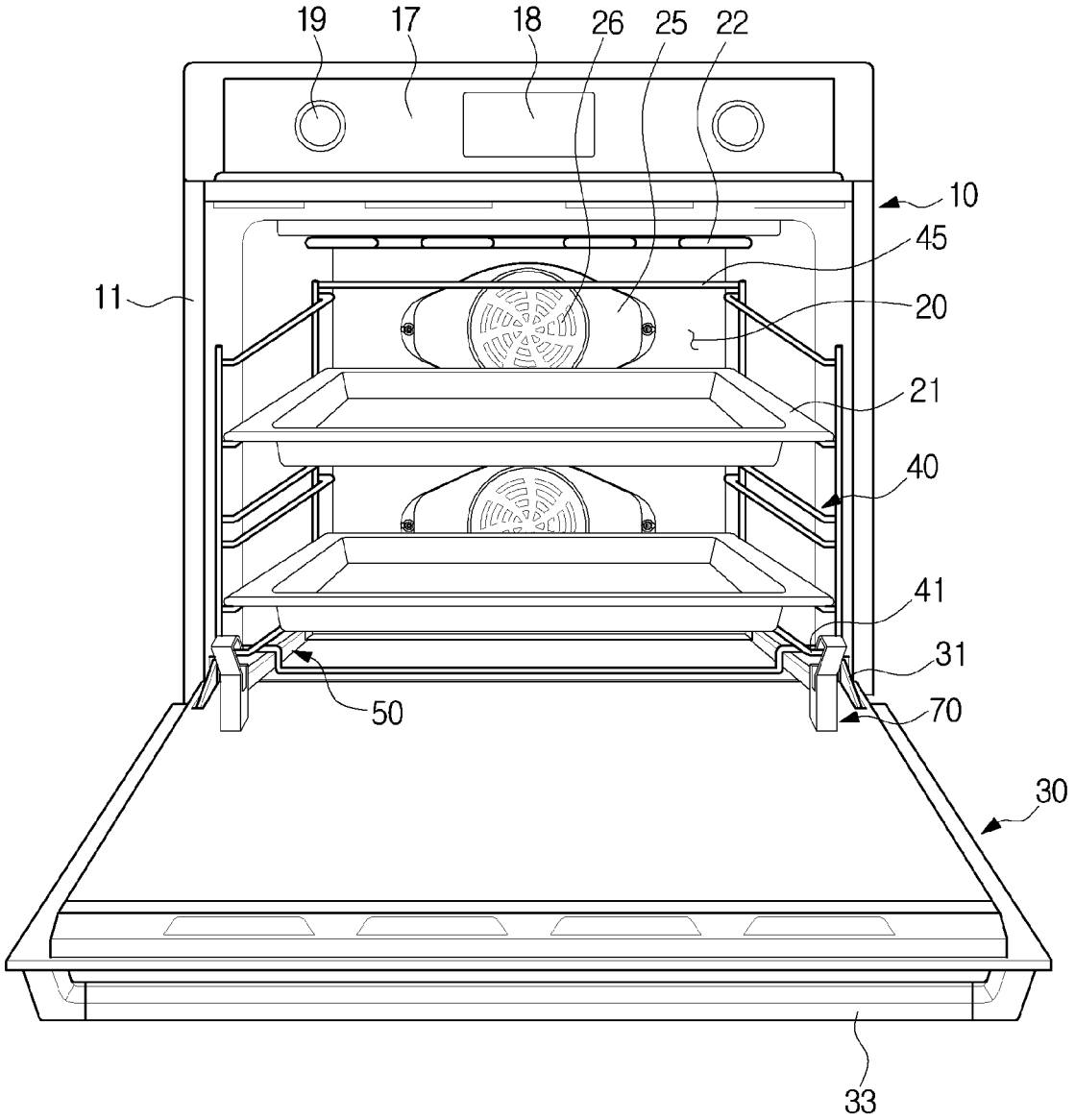
FIG. 2 illustrates that a door of the oven is opened according to an embodiment of the present disclosure.
Figure 3:
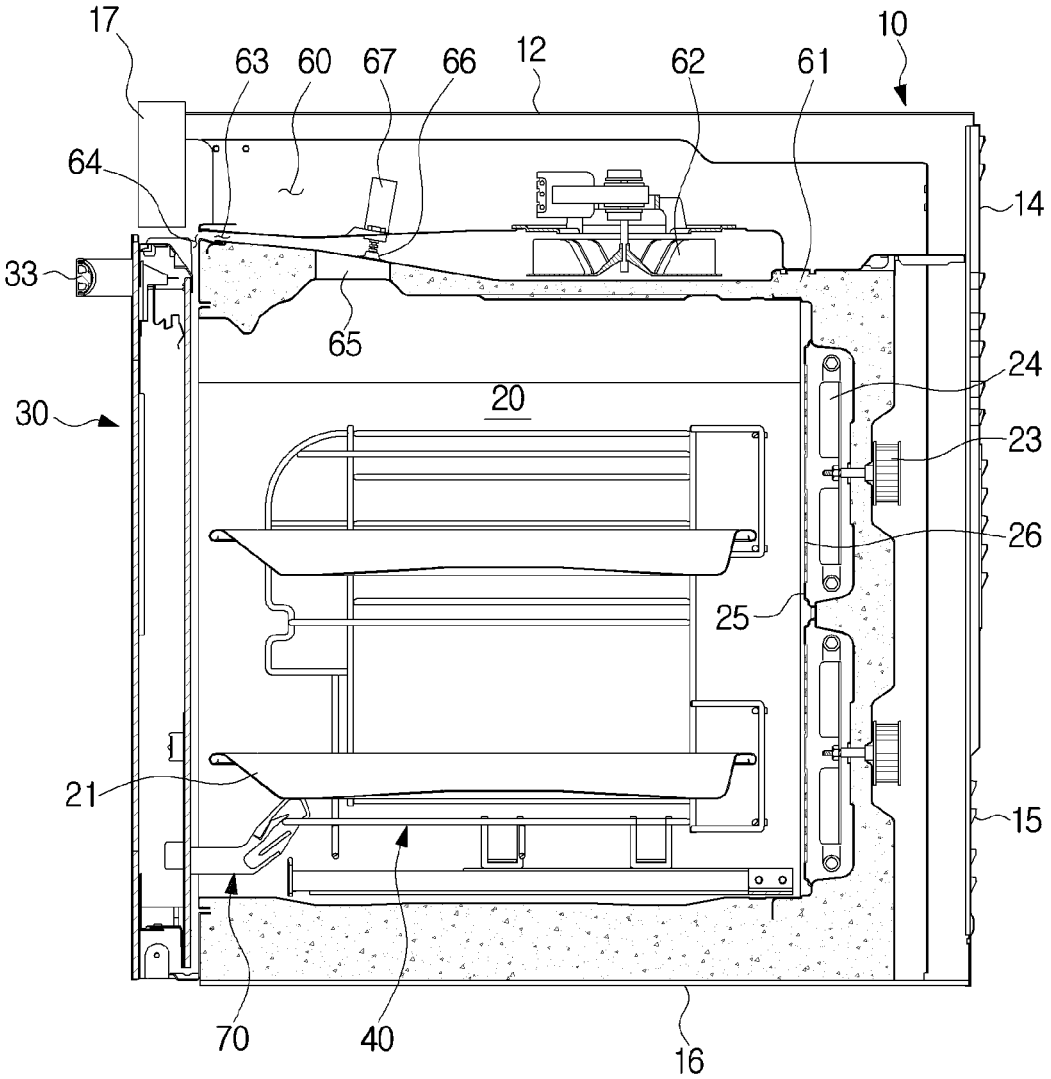
FIG. 3 is a side cross-sectional view of the oven according to an embodiment of the present disclosure.

FIG. 1 is a perspective view of an oven according to an embodiment of the present disclosure, FIG. 2 illustrates that a door of the oven is opened according to an embodiment of the present disclosure, and FIG. 3 is a side cross-sectional view of the oven according to an embodiment of the present disclosure.

As illustrated in FIGS. 1 to 3, an oven may include a main body 10 forming an outer appearance, a cooking chamber 20 provided inside the main body 10 and having an open front side, and a door 30 provided at a front side of the main body 10 to open and close the cooking chamber 20.

The main body 10 may include a front panel 11 forming a front appearance, an upper panel 12 forming an upper appearance, a side panel 13 forming a side appearance, a rear panel 14 forming a rear appearance, and a lower panel 16 forming a lower appearance.

An electrical component chamber cover 17 covering a front side of an electrical component chamber 60, which will be described later, may be provided above a front surface of the front panel 13, and a display unit 18 for displaying information on various operations of the oven and an operation unit 19 for operating the oven may be mounted on the electrical component chamber cover 17.

The rear panel 14 may be provided with a plurality of through holes 15 to allow air to be sucked into the electrical component chamber 60, which will be described later. The air sucked into the electrical component chamber 60 through the through holes 150 may flow through the electrical component chamber 60 to cool electrical components.

The cooking chamber 20 is formed in a box shape inside the main body 10, and the front side of the cooking chamber 20 may be opened for putting in and out of the food.

An oven rack 40 by which a plurality of shelves 21 on which food may be placed is supported may be provided inside the cooking chamber 20.

The oven rack 40 is moved in the front-rear direction along a rail 50. A detailed description of the oven rack 40 and the rail 50 will be described below.

The cooking chamber 20 may be provided with a heater 22 for heating food, and the heater 22 may be an electric heater including an electric resistor.

However, the heater 22 is not limited to an electric heater, and may be a gas heater that generates heat by burning gas.

Thus, the oven may include an electric oven and a gas oven.

Circulation fans 24 for circulating air in the cooking chamber 20 to heat food evenly and circulation motors 23 for driving the circulation fans 24 may be provided at the rear of the cooking chamber 20.

A fan cover 25 covering each of the circulation fans 24 may be provided at the front of each of the circulation fans 24 and fan cover through holes 26 may be formed on the fan cover 25 to allow air to flow therethrough.

The opened front side of the cooking chamber 20 may be opened and closed by the door 30, and the door 30 may be rotatably coupled to a lower portion of the main body 10 by door hinges 31.

A door handle 33 may be provided at an upper portion of a front surface of the door 30 so that the door 30 may be opened and closed by a user.

The oven may be provided with the electrical component chamber 60 accommodating electric components for controlling operations of various components.

The electrical component chamber 60 is provided above the cooking chamber 20, and a heat insulating material 61 for insulating the electrical component chamber 40 and the cooking chamber 20 may be provided between the electrical component chamber 60 and the cooking chamber 20 in order to prevent heat in the cooking chamber 20 from being transferred to the electrical component chamber 60.

The heat insulating material 61 may be provided to cover the entire outside of the cooking chamber 20 so that heat in the cooking chamber 20 is not transferred to the outside of the oven as well as between the electrical component chamber 60 and the cooking chamber 20.

A cooling structure for cooling the electrical component chamber 60 by circulating air around the electrical component chamber 60 may be provided in the oven because a temperature inside the electrical component chamber 60 may be raised by heat in various electric components.

The cooling structure of the oven may include a cooling fan unit 62 for flowing air and a cooling channel 63 for discharging air sucked by the cooling fan unit 62 to the front of the oven.

Air outside the oven may be sucked into the electrical component chamber 60 through the through holes 15 formed on the rear panel 14, and the air sucked into the electrical component chamber 60 may flow the inside of the electrical component chamber 60 to cool the electrical components, and then may flow along the cooling channel 63 to be discharged to the front of the oven through an outlet port 64.

A part of air in the cooking chamber 20 may be sucked to the cooling channel 63 side through an exhaust channel 65 and discharged to a front side of the oven.

A bypass hole 66 for introducing a part of air flowing from the cooling channel 63 to the outlet port 64 into the exhaust channel 65 may be additionally formed, and the bypass hole 66 is opened and closed by an opening and closing device 67.

Because an inflow amount of air in which a part of air flowing from the cooling channel 63 to the outlet port 64 flows into the exhaust channel 65 is adjusted according to the opening and closing of the bypass hole 66 by the opening and closing device 67, an exhaust amount of air exhausted from the cooking chamber 20 to the exhaust channel 65 may be adjusted.

Figure 4:
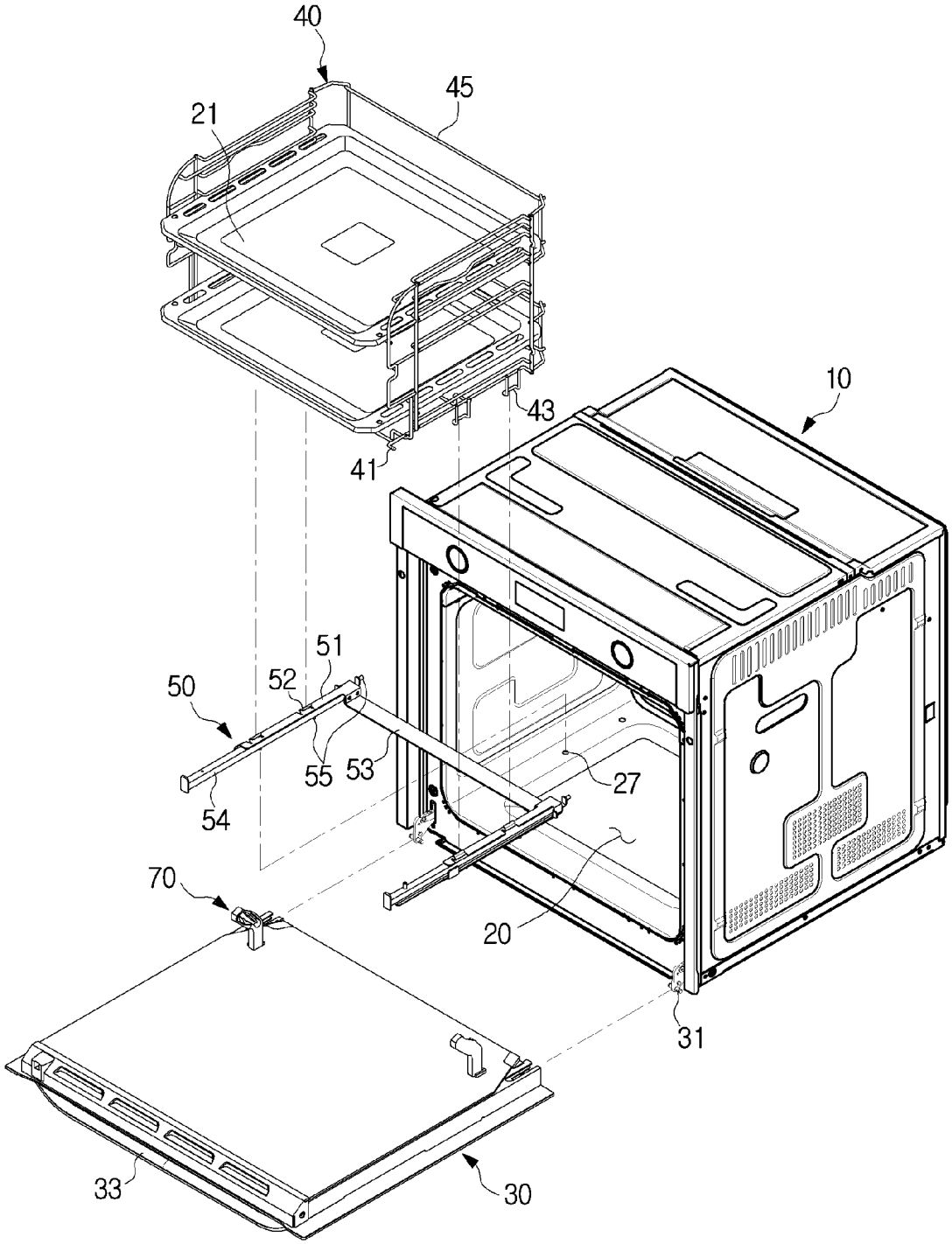
FIG. 4 illustrates a state in which the door to which a guide member is coupled, an oven rack on which a plurality of shelves is supported, and a rail are disassembled from a main body of the oven, according to an embodiment of the present disclosure.
Figure 5:
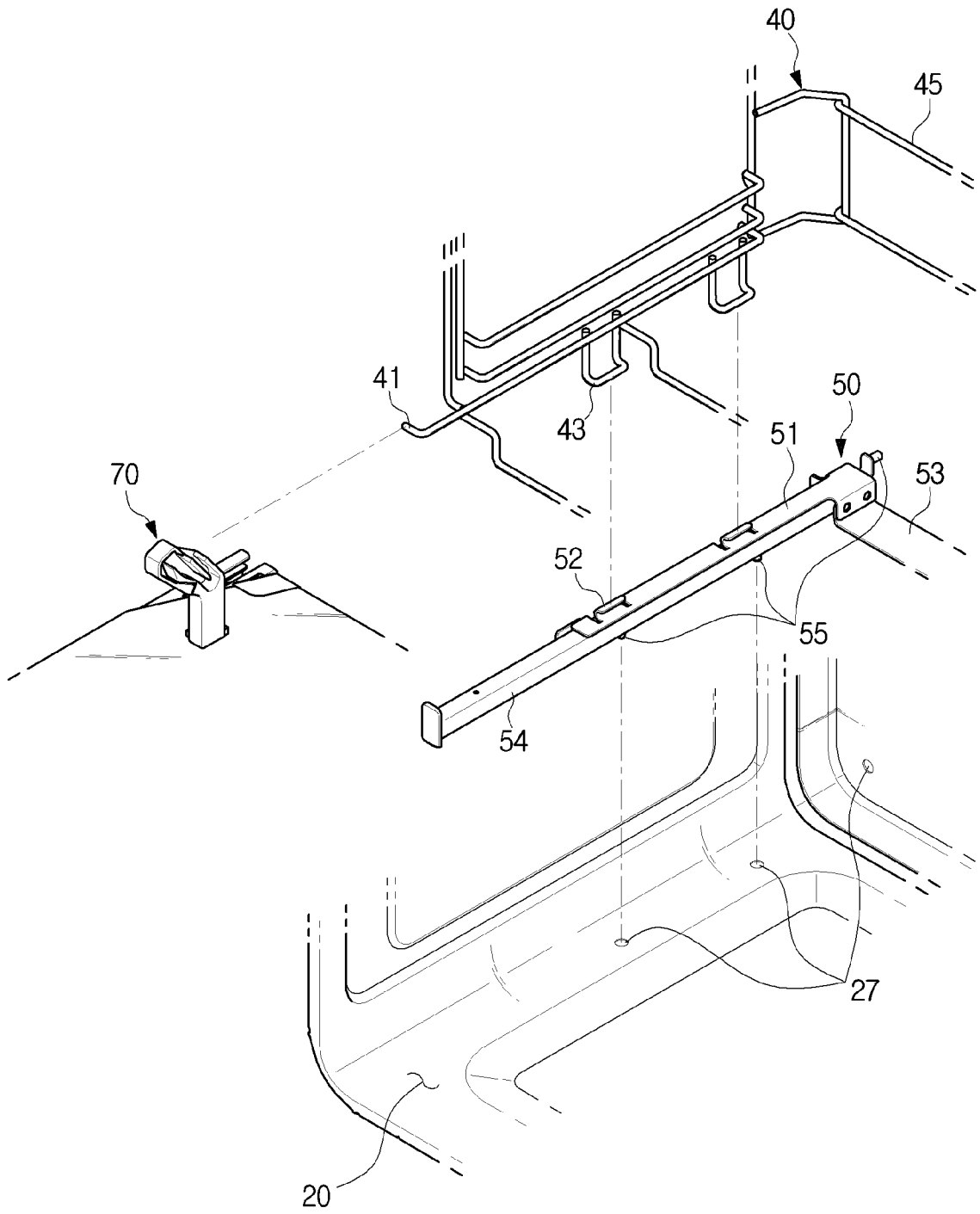
FIG. 5 illustrates that the oven rack is coupled to the rail and the rail is coupled to the inside of the cooking chamber, according to an embodiment of the present disclosure.

FIG. 4 illustrates a state in which the door to which a guide member is coupled, an oven rack on which a plurality of shelves is supported, and a rail are disassembled from a main body of the oven, according to an embodiment of the present disclosure, and FIG. 5 illustrates that the oven rack is coupled to the rail and the rail is coupled to the inside of the cooking chamber, according to an embodiment of the present disclosure.

As illustrated in FIGS. 4 and 5, the oven may include the oven rack 40 provided inside the cooking chamber 20 and supporting a plurality of shelves, the rail 50 for moving the oven rack 40 in the front-rear direction, and a guide member 70 coupled to a rear surface of the door 30 and connected to the oven rack 40 according to opening and closing of the door 30 to move the oven rack 40 in the front-rear direction.

The oven racks 40 are provided at opposite sides of the cooking chamber 20, respectively, and the plurality of shelves 21 on which food may be placed is supported thereon.

The oven rack 40 may include a connection protrusion 41 provided on a front end thereof to be connected to the guide member 70 according to opening and closing of the door 30, a plurality of coupling portions 43 detachably coupled to the rail 50, and a connection rod 45 connecting rear ends of the oven racks 40 provided on opposite sides of the inside of the cooking chamber 20, respectively.

The connection protrusion 41 is provided on the front end of the oven rack 40 and may protrude toward the guide member 70 coupled to the rear surface of the door 30.

The connection protrusion 41 may be provided to be connected to or separated from the guide member 70 according to opening or closing of the door 30.

That is, the oven rack 40 may be connected to or separated from the guide member 70 according to opening or closing of the door.

A detailed explanation thereof will be given later.

A plurality of the coupling portions 43 is provided at a lower portion of the oven rack 40 and may be detachably coupled to coupling hooks 52 of the rail 50, which will be described later.

A plurality of the connection rods 45 is provided to connect the rear ends of the oven racks 40 provided on the opposite sides of the cooking chamber 20, respectively, thereby preventing the oven racks 40 from being twisted while moving in the front-rear direction.

The rail 50 is provided movably in the front-rear direction inside the cooking chamber 20 such that the oven rack 40 may be moved in the front-rear direction.

The rail 50 may include a first rail 51 coupled to the lower portion of the oven rack 40, and a second rail 54 coupled to the inside of the cooking chamber 20 to guide such that the first rail 51 moves in the front-rear direction.

The first rail 51 may include a plurality of the coupling hooks 52 to which the plurality of coupling portions 43 provided at the lower portion of the oven rack 40 is detachably coupled, and a reinforcement frame 53 for preventing the first rail 51 from being twisted when moving in the front-rear direction.

The first rail 51 may be provided to be movable in the front-rear direction along the second rail 54 such that the oven rack 40 coupled to the first rail 51 is moved in the front-rear direction.

The second rail 54 may include a plurality of bosses 55 detachably coupled to the inside of the cooking chamber 20.

A plurality of coupling holes 27 in which a plurality of bosses 55 is detachably coupled may be provided inside the cooking chamber 20.

The second rail 54 is fixed to the inside of the cooking chamber 20 and may guide the first rail 51 to move in the front-rear direction.

Because the oven rack 40 is detachably coupled to the rail 50 and the rail 50 is detachably coupled to the inside of the cooking chamber 20, cleaning of the oven rack 40, the rail 50, or the inside of the cooking chamber 20 may be easy.

The guide members 70 are provided in a pair and are coupled to both of the left and right sides of the rear surface of the door 30, respectively, and may guide the oven rack 40 to be moved in the front-rear direction according to opening and closing of the door 30.

The guide member 70 is coupled to the rear surface of the door 30 in a position adjacent to the door hinge 31, and may be provided such that one side thereof toward the connection protrusion 41 of the oven rack 40 is opened.

Figure 6:
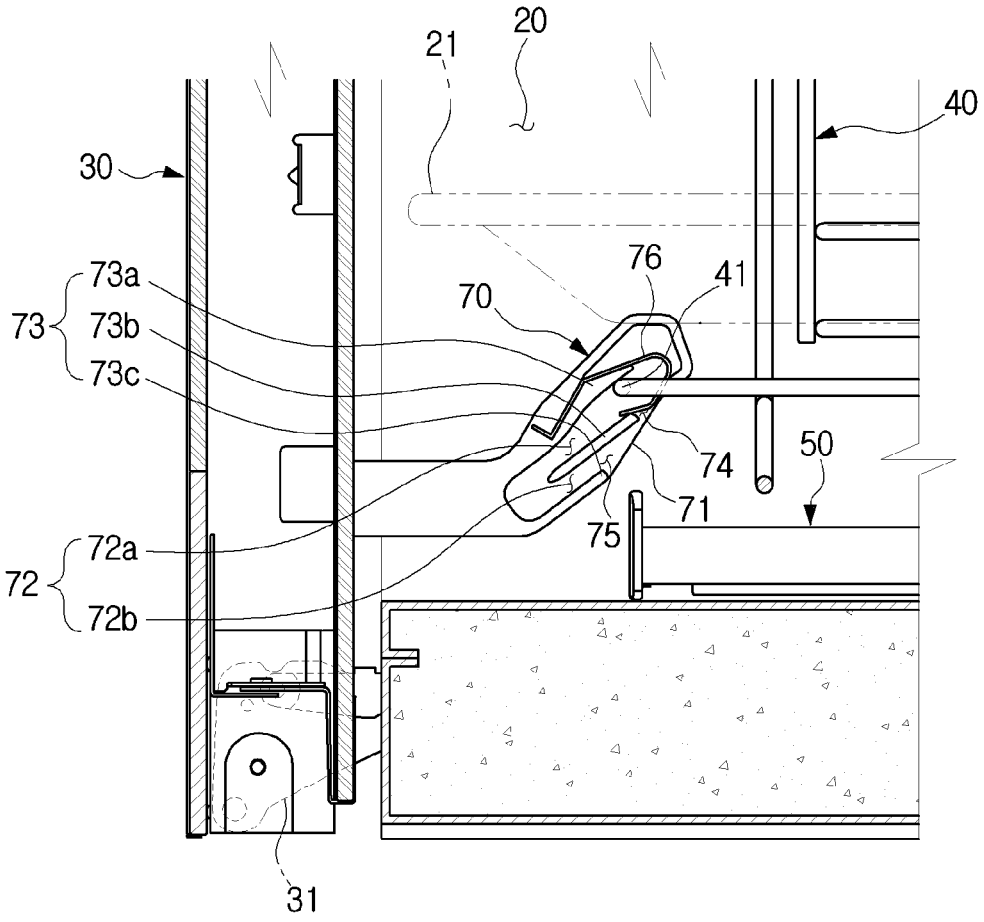
FIG. 6 illustrates a state in which a connection protrusion of the oven rack is connected to the guide member when the door of the oven is closed, according to an embodiment of the present disclosure.
Figure 7:
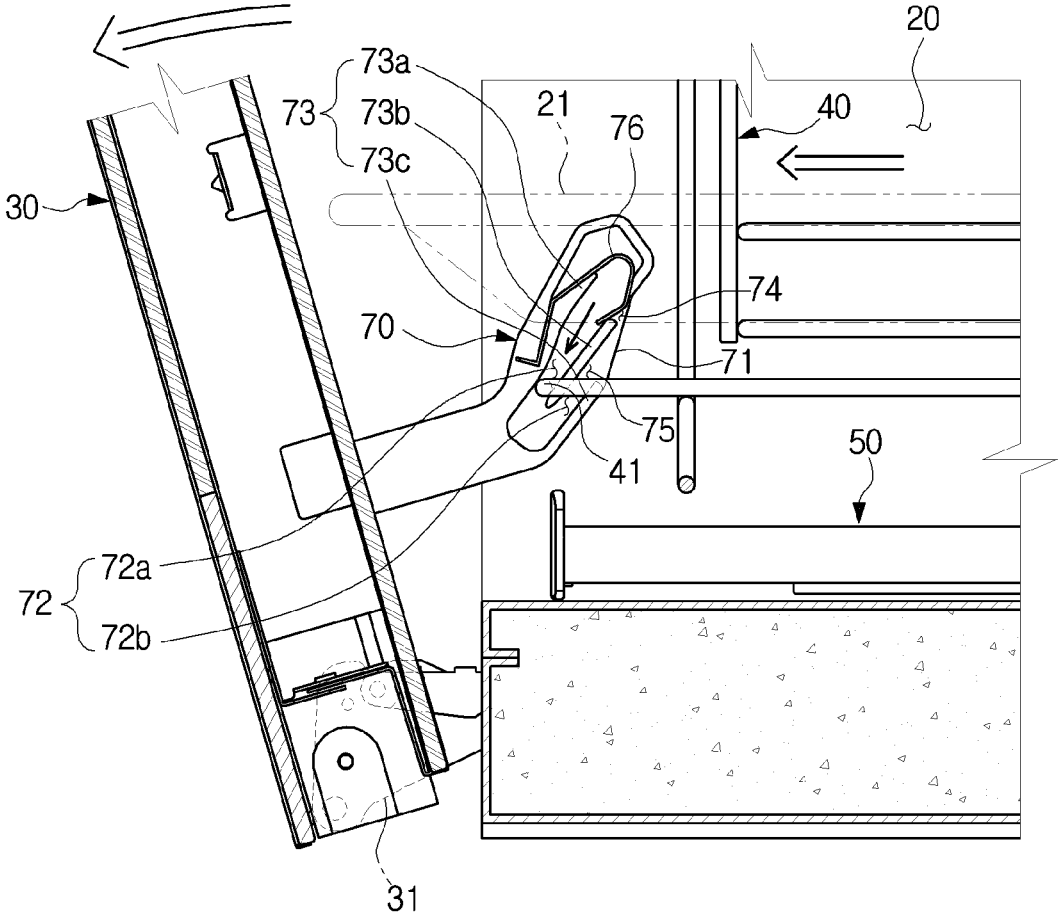
FIG. 7 illustrates that the connection protrusion of the oven rack is guided by the guide member when the door of the oven is opened so that the oven rack is withdrawn from the cooking chamber, according to an embodiment of the present disclosure.
Figure 8:
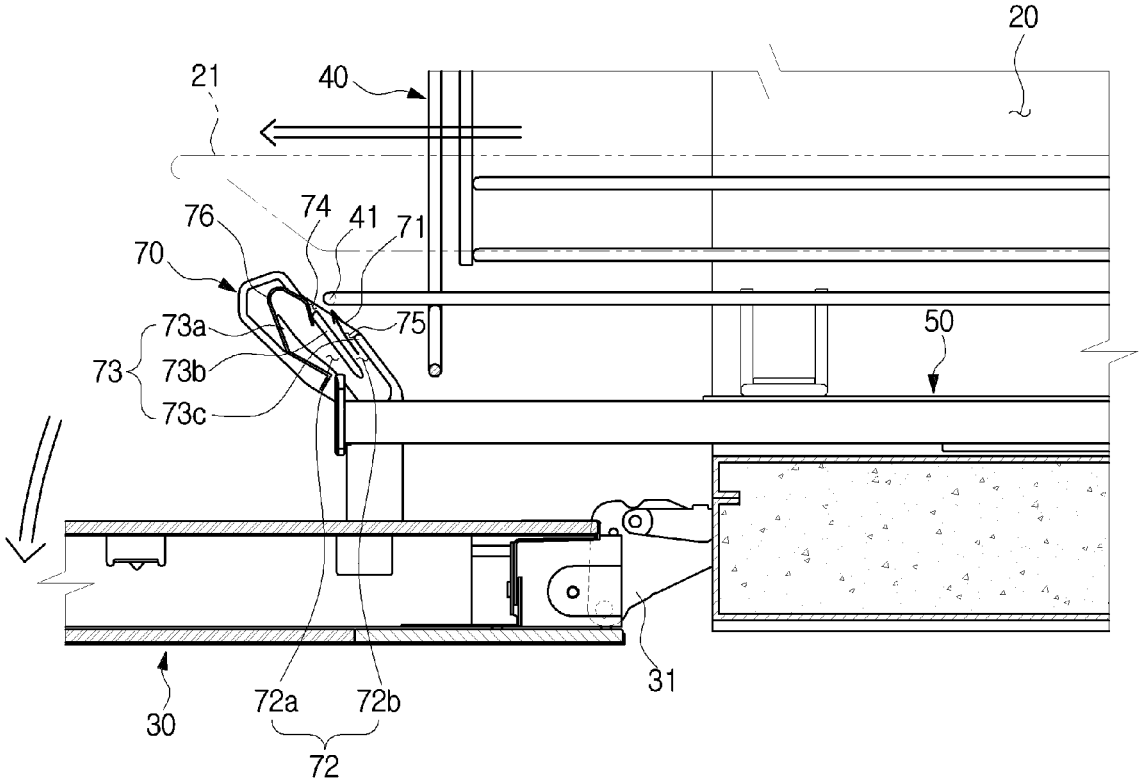
FIG. 8 illustrates that the oven door is completely opened so that a portion of the oven rack is withdrawn from the cooking chamber and the connection protrusion of the oven rack is separated from the guide member, according to an embodiment of the present disclosure.
Figure 9:
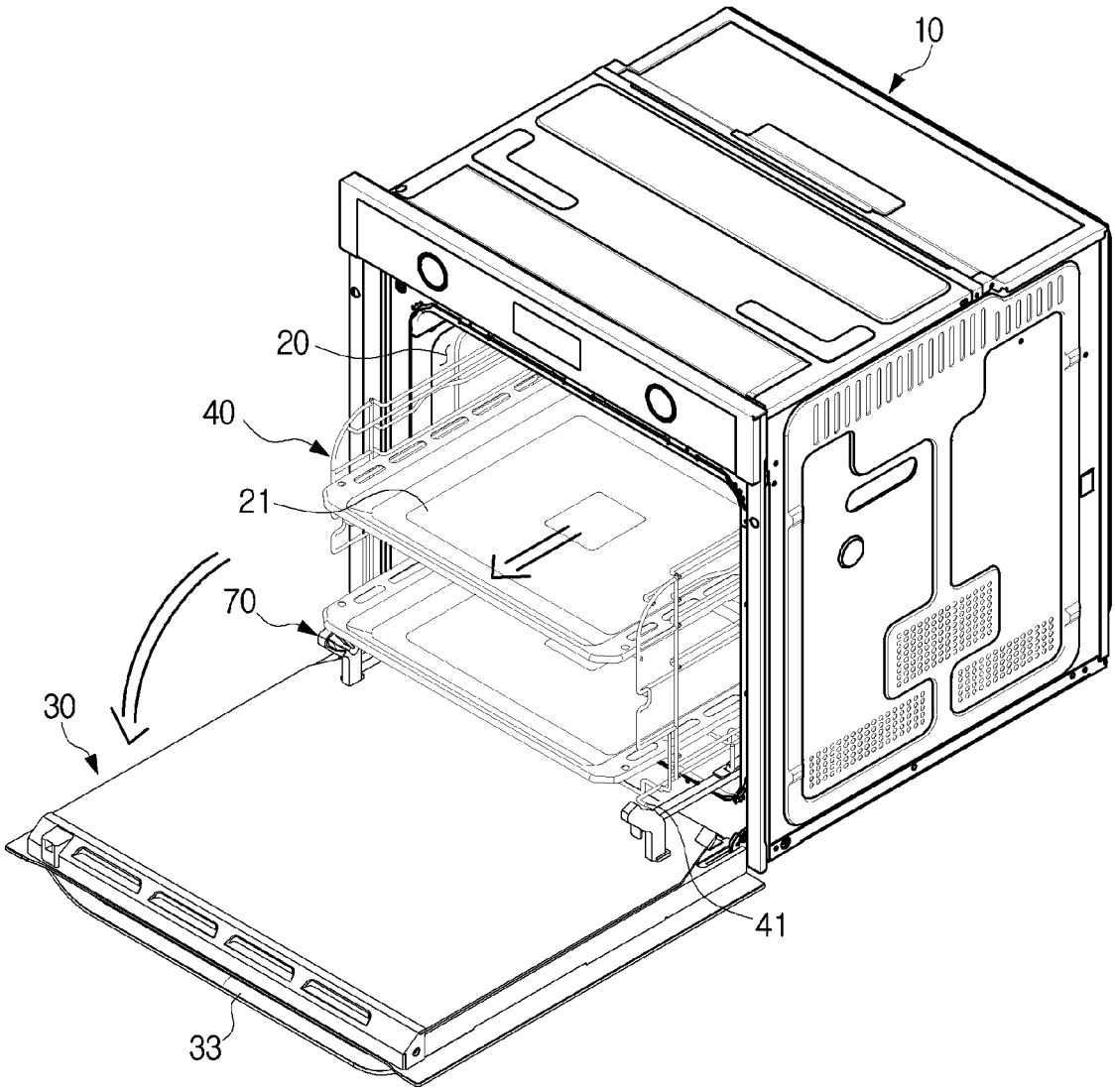
FIG. 9 is a perspective view illustrating that the oven door is completely opened so that the oven rack is withdrawn from the cooking chamber, according to an embodiment of the present disclosure.
Figure 10:
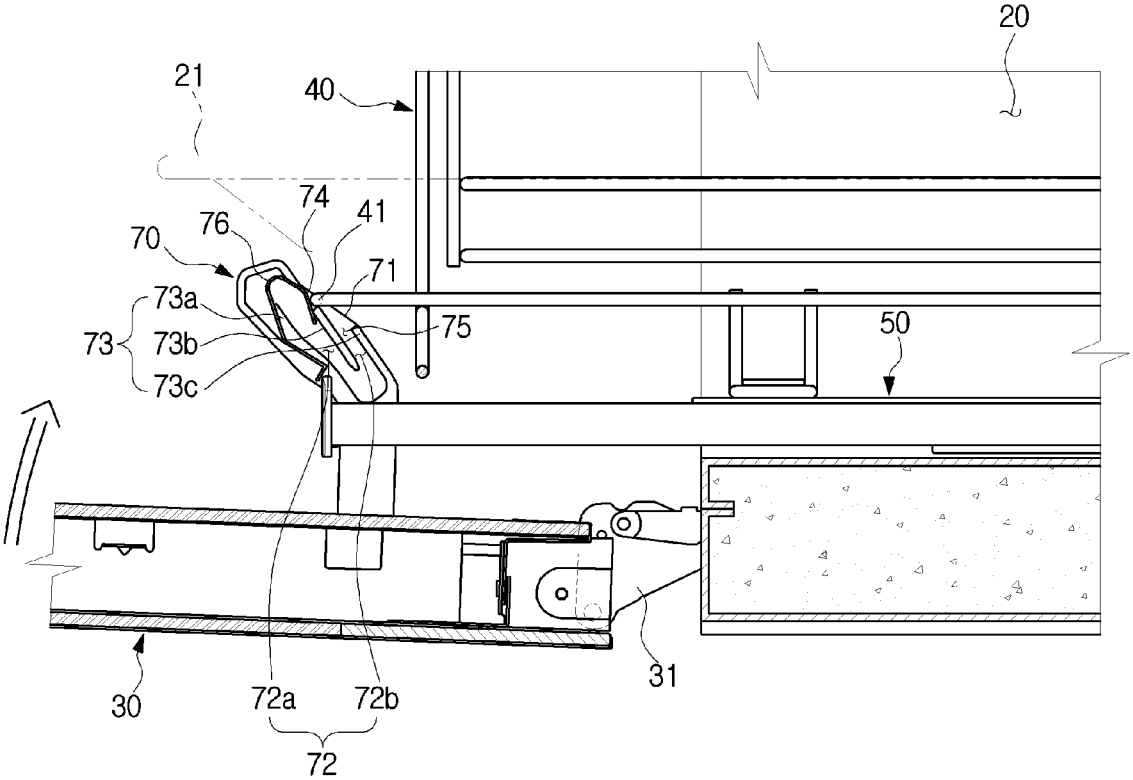
FIG. 10 illustrates that the connection protrusion of the oven rack comes into contact with an opening and closing member of the guide member when the door of the oven is closed, according to an embodiment of the present disclosure.
Figure 11:
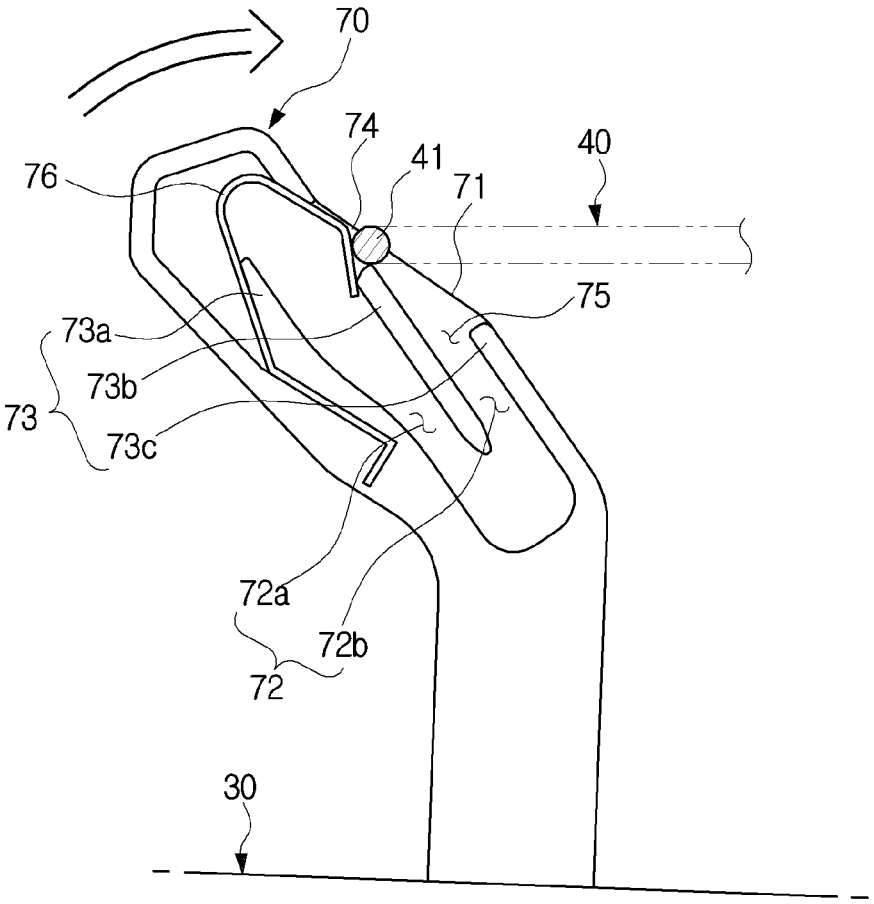
FIG. 11 is an enlarged view of the guide member and the connection protrusion shown in FIG. 10.
Figure 12:
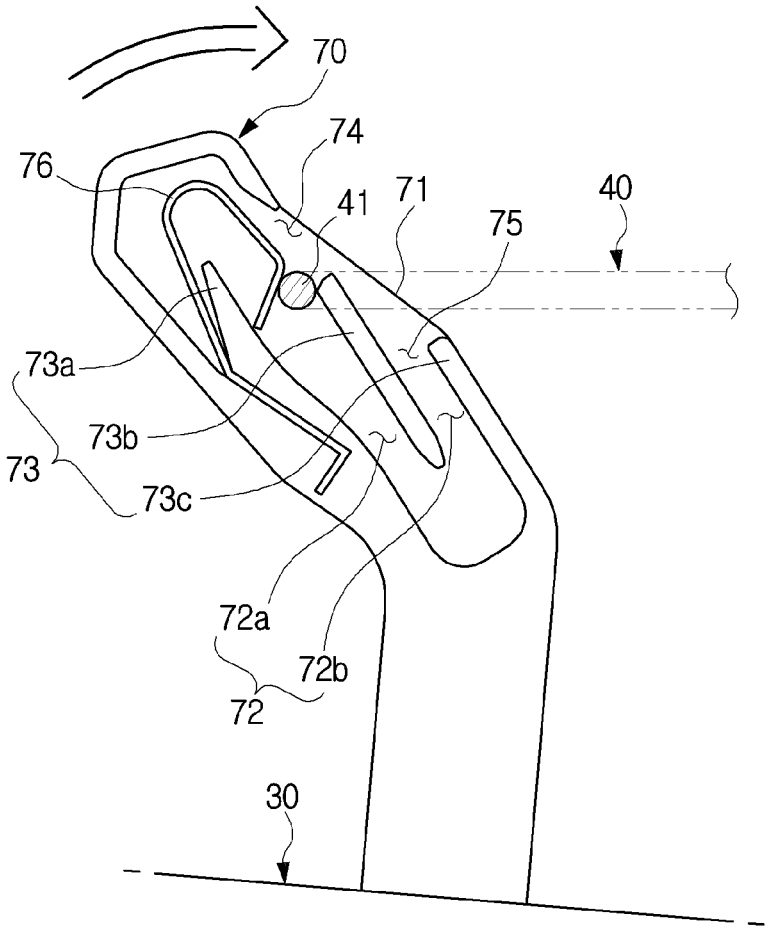
FIG. 12 illustrates that the connection protrusion of the oven rack enters into an introducing portion of the guide member when the door of the oven is closed, according to an embodiment of the present disclosure.
Figure 13:
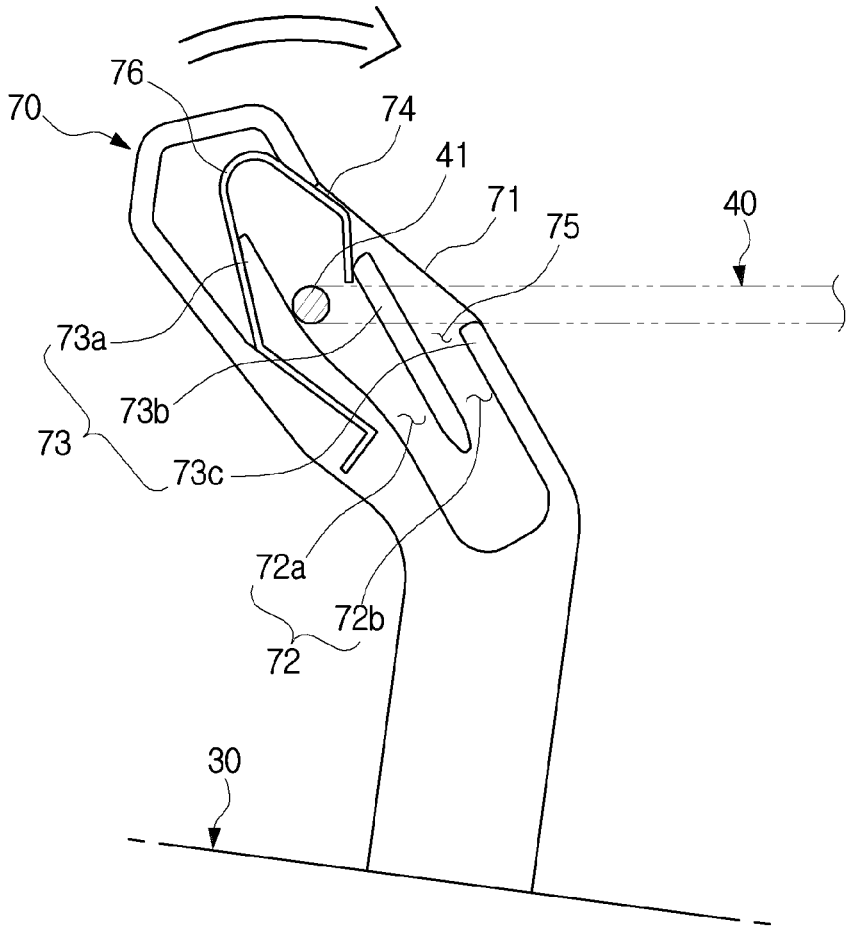
FIG. 13 illustrates that the opening and closing member closes the introducing portion after the connection protrusion of the oven rack has entered into an introducing portion of the guide member when the door of the oven is closed, according to an embodiment of the present disclosure.
Figure 14:
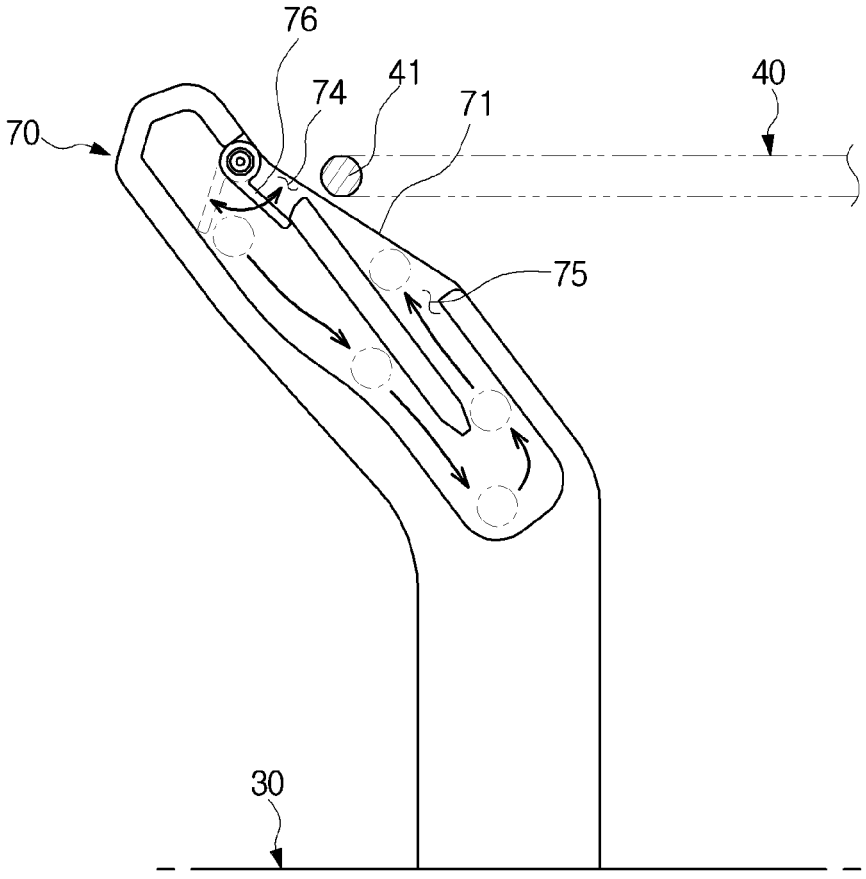
FIG. 14 illustrates an opening and closing member of an oven according to another embodiment of the present disclosure.

FIG. 6 illustrates a state in which a connection protrusion of the oven rack is connected to the guide member when the door of the oven is closed, according to an embodiment of the present disclosure, FIG. 7 illustrates that the connection protrusion of the oven rack is guided by the guide member when the door of the oven is opened so that the oven rack is withdrawn from the cooking chamber, according to an embodiment of the present disclosure, FIG. 8 illustrates that the oven door is completely opened so that a portion of the oven rack is withdrawn from the cooking chamber and the connection protrusion of the oven rack is separated from the guide member, according to an embodiment of the present disclosure, FIG. 9 is a perspective view illustrating that the oven door is completely opened so that the oven rack is withdrawn from the cooking chamber, according to an embodiment of the present disclosure, FIG. 10 illustrates that the connection protrusion of the oven rack comes into contact with an opening and closing member of the guide member when the door of the oven is closed, according to an embodiment of the present disclosure, FIG. 11 is an enlarged view of the guide member and the connection protrusion shown in FIG. 10, FIG. 12 illustrates that the connection protrusion of the oven rack enters into an introducing portion of the guide member when the door of the oven is closed, according to an embodiment of the present disclosure, FIG. 13 illustrates that the opening and closing member closes the introducing portion after the connection protrusion of the oven rack has entered into an introducing portion of the guide member when the door of the oven is closed, according to an embodiment of the present disclosure, and FIG. 14 illustrates an opening and closing member of an oven according to another embodiment of the present disclosure.

As illustrated in FIGS. 6 to 13, the guide member 70 may include an opening 71 through which the connection protrusion 41 is introduced into and withdrawn from the guide member 70, a guide slot 72 for guiding the connection protrusion 41 introduced into the opening 71, and a guide wall 73 forming the guide slot 72.

The connection protrusion 41 is connected to the guide member 70 in a state where the door 30 of the oven is closed, and may be withdrawn from the guide member 70 through the opening 71 to be separated from the guide member 70 when the door 30 is completely opened.

When the door 30 is closed in the open state, the connection protrusion 41 may be introduced into the guide member 70 through the opening 71 to be connected to the guide member 70.

The guide slot 72 may include a first guide slot 72*a* for guiding the connection protrusion 41 introduced into the opening 71 to move the oven rack 40 toward a front side, and a second guide slot 72*b* connected to the first guide slot 72*a* and guiding the connection protrusion 41 to be withdrawn to the opening 71.

The guide wall 73 may include a first guide wall 73*a* to which the connection protrusion 41 is fixed in the state where the door 30 is closed, a second guide wall 73*b* for guiding the connection protrusion 41 moving along the first guide slot 72*a* so that the oven rack 40 moves toward the front side when the door 30 is opened, and a third guide wall 73*c* for guiding the connection protrusion 41 to be withdrawn to the opening 71 when the door 30 is completely opened.

The first guide slot 72*a* may be formed between the first guide wall 73*a* and the second guide wall 73*b*, and the second guide slot 72*b* may be formed between the second guide wall 73*b* and the third guide wall 73*c*.

The guide member 70 may include an introducing portion 74 connecting the opening 71 to the first guide slot 72*a* such that the connection protrusion 41 is introduced into the first guide slot 72*a* through the opening 71, and a withdrawing portion 75 connecting the opening 71 to the second guide slot 72*b* such that the connection protrusion 41 is withdrawn to the opening 71.

The introducing portion 74 is opened and closed by an opening and closing member 76, and the opening and closing member 76 may open the introducing portion 74 to allow the connection protrusion 41 to be introduced into the introducing portion 74 and then close the introducing portion 74 not to allow the connection protrusion 41 to be withdrawn through the introducing portion 74.

Therefore, the connection protrusion 41 introduced into the introducing portion 74 may not be withdrawn through the introducing portion 74, but may be withdrawn only through the withdrawing portion 75.

The opening and closing member 76 for opening and closing the introducing portion 74 may be provided as an elastic leaf spring.

As illustrated in FIG. 14, the opening and closing member 76 may be provided as an elastic torsion spring.

Similarly, even when provided as a torsion spring, the opening and closing member 76 may not allow the connection protrusion 41 introduced into the introducing portion 74 to be withdrawn through the introducing portion 74, but may allow the connection protrusion 41 to be withdrawn only through the withdrawing portion 75.

Although not shown in the drawings, as described above, as long as the opening and closing member 76 is configured such that the connection protrusion 41 introduced into the introducing portion 74 may not be withdrawn through the introducing portion 74, but may be withdrawn only through the withdrawing portion 75, the opening and closing member 76 may be implemented using a link structure, a cam structure, a latch structure, and the like.

Next, an operation of moving the oven rack 40 in the front-rear direction according to opening and closing of the door 30 will be described with reference to FIGS. 6 to 13.

As illustrated in FIG. 6, in the state where the door 30 is closed, the connection protrusion 41 of the oven rack 40 may be connected to the guide member 70.

In this case, the connection protrusion 41 may be fixed to the first guide wall 73*a* of the guide member 70.

As illustrated in FIG. 7, when the door 30 is partially opened, the connection protrusion 41 may come into contact with the second guide wall 73*b*.

When the door 30 is further opened in a state where the connection protrusion 41 is in contact with the second guide wall 73*b*, the connection protrusion 41 may be moved by being guided along the second guide wall 73*b* through the first guide slot 72*a*.

When the connection protrusion 41 is guided along the second guide wall 73*b* through the first guide slot 72*a*, the oven rack 40 is moved toward the front side, so that a portion thereof may be withdrawn from the cooking chamber 20.

As illustrated in FIGS. 8 and 9, when the door 30 is completely opened, the oven rack 40 is moved toward the front side as much as the connection protrusion 41 is guided along the second guide wall 73*b*, so that a portion of a front surface thereof may be withdrawn from the cooking chamber 20.

When the door 30 is completely opened, because a portion of the oven rack 40 on which a plurality of shelves 21 is supported is withdrawn from the cooking chamber 20, the user may take out the shelves 21 in the outside of the cooking chamber 20 and put out food or the like placed on the shelves 21, without putting his or her hand into the cooking chamber 20 exposed to a high temperature.

At this time, the connection protrusion 41 may be guided along the third guide wall 73*c* through the second guide slot 72*b*.

The connection protrusion 41 guided along the third guide wall 73*c* may be withdrawn outside the guide member 70 through the withdrawing portion 75 and the opening 71 and separated from the guide member 70.

That is, as the connection protrusion 41 is separated from the guide member 70, the oven rack 40 may be separated from the guide member 70.

As described above, the guide member 70 allows the oven rack 40 to be moved linearly in the front-rear direction through the rotational movement of the door 30, so that the oven rack 40 may be automatically withdrawn from the cooking chamber 20 when the door 30 is opened.

As illustrated in FIGS. 10 and 11, when the door 30 is partially closed in a state where the door 30 is completely opened, the connection protrusion 41 may be introduced into the guide member 70 through the opening 71 of the guide member 70 to come into contact with the opening and closing member 76.

As illustrated in FIG. 12, when the door 30 is further closed in a state where the connection protrusion 41 is in contact with the opening and closing member 76, the opening and closing member 76 may open the introducing portion 74 by the connection protrusion 41.

When the introducing portion 74 is opened, the connection protrusion 41 may be introduced into the first guide slot 72*a* through the introducing portion 74.

As illustrated in FIG. 13, when the connection protrusion 41 is introduced into the introducing portion 74, the connection protrusion 41 is fixed while being in contact with the first guide wall 73*a*, and the oven rack 40 may be moved rearward by the guide member 70 rotated together with the door 30 to be introduced into the cooking chamber 20.

As illustrated in FIG. 6, when the door 30 is completely closed, the oven rack 40 may be completely introduced into the cooking chamber 20.

In the state where the door 30 is completely opened as illustrated in FIG. 9, although the oven rack 40 may be introduced into the cooking chamber 20 through an operation of closing the door 30 as illustrated in FIGS. 10 to 13, because the oven rack 40 is be in a state of being separated from the guide member 70, the user may directly push the oven rack 40 into the cooking chamber 20 in the state where the door 30 is opened, so that the oven rack 40 may be introduced into the cooking chamber 20.

Therefore, although the oven rack 40 is always automatically withdrawn when the door 30 is opened, in the state where the door 30 is opened, the user may close the door 30 after manually pushing the oven rack 40 into the cooking chamber 20, or the oven rack 40 may be automatically introduced into the cooking chamber 20 by the operation of closing the door 30.

Figure 15:
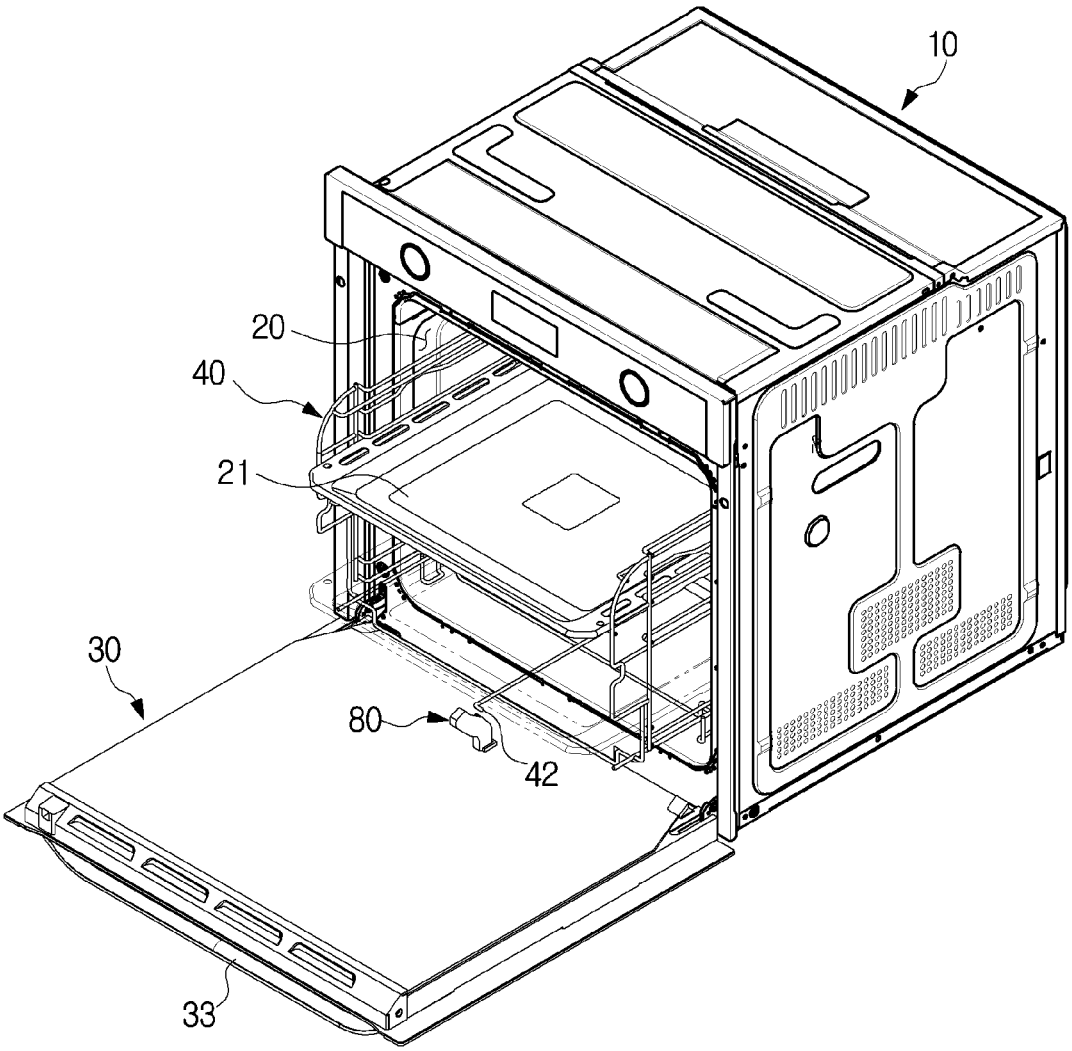
FIG. 15 illustrates a guide member and a connection protrusion of an oven according to another embodiment of the present disclosure.

FIG. 15 illustrates a guide member and a connection protrusion of an oven according to another embodiment of the present disclosure.

As illustrated in FIG. 15, a guide member 80 may be provided at a lower central portion of the rear surface of the door 30.

In a state where the guide member 80 is provided at a lower central portion of the rear surface of the door 30, the oven rack 40 may be provided with a connection protrusion 42 to correspond to the position of the guide member 80.

The guide member 80 and the connection protrusion 42 are different only in position from the guide member 70 and the connection protrusion 41 illustrated in FIGS. 1 to 14, and the rest of the configuration is the same.

Figure 16:
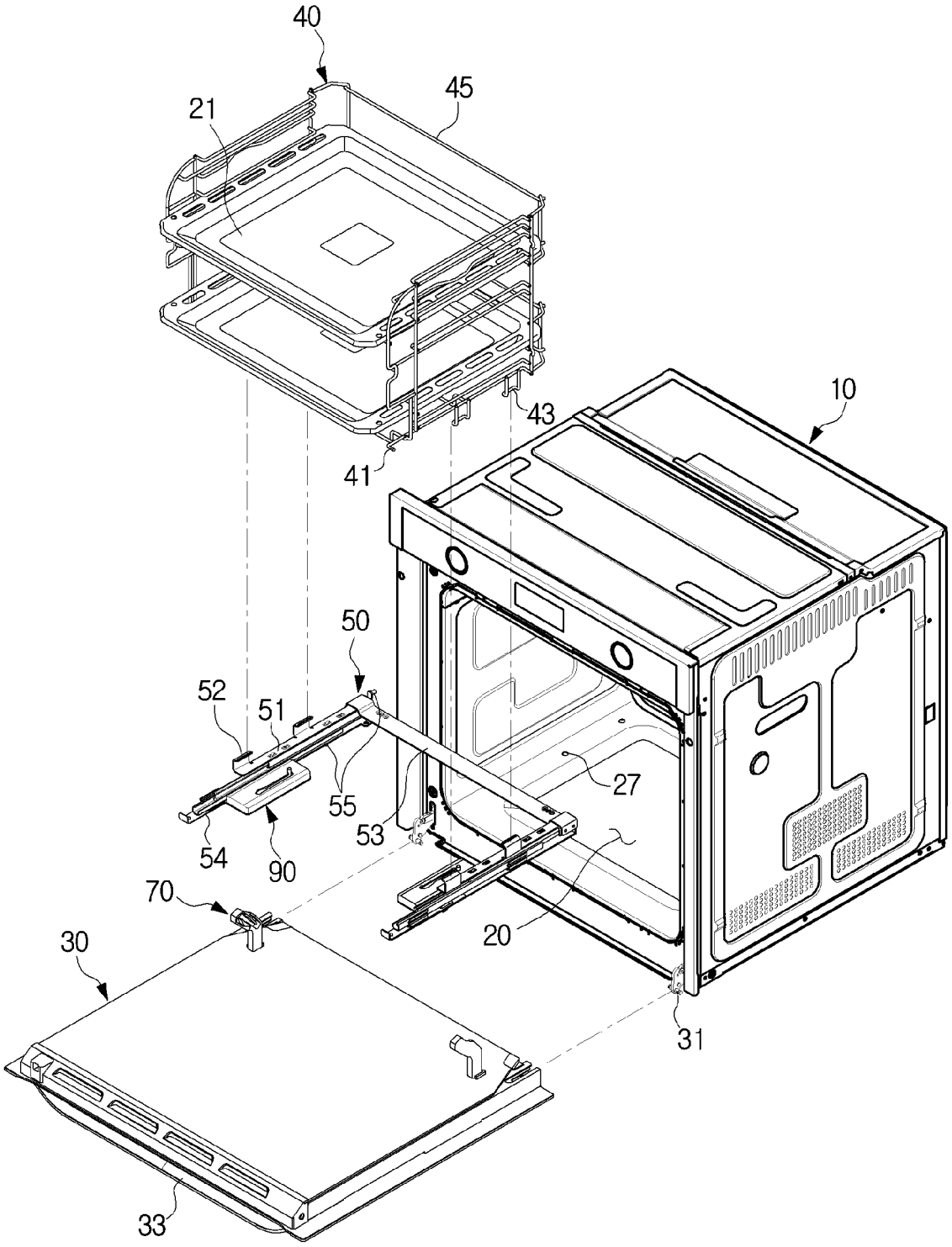
FIG. 16 illustrates an oven in which a withdrawal assist device is provided on a rail, according to another embodiment of the present disclosure.
Figure 17:
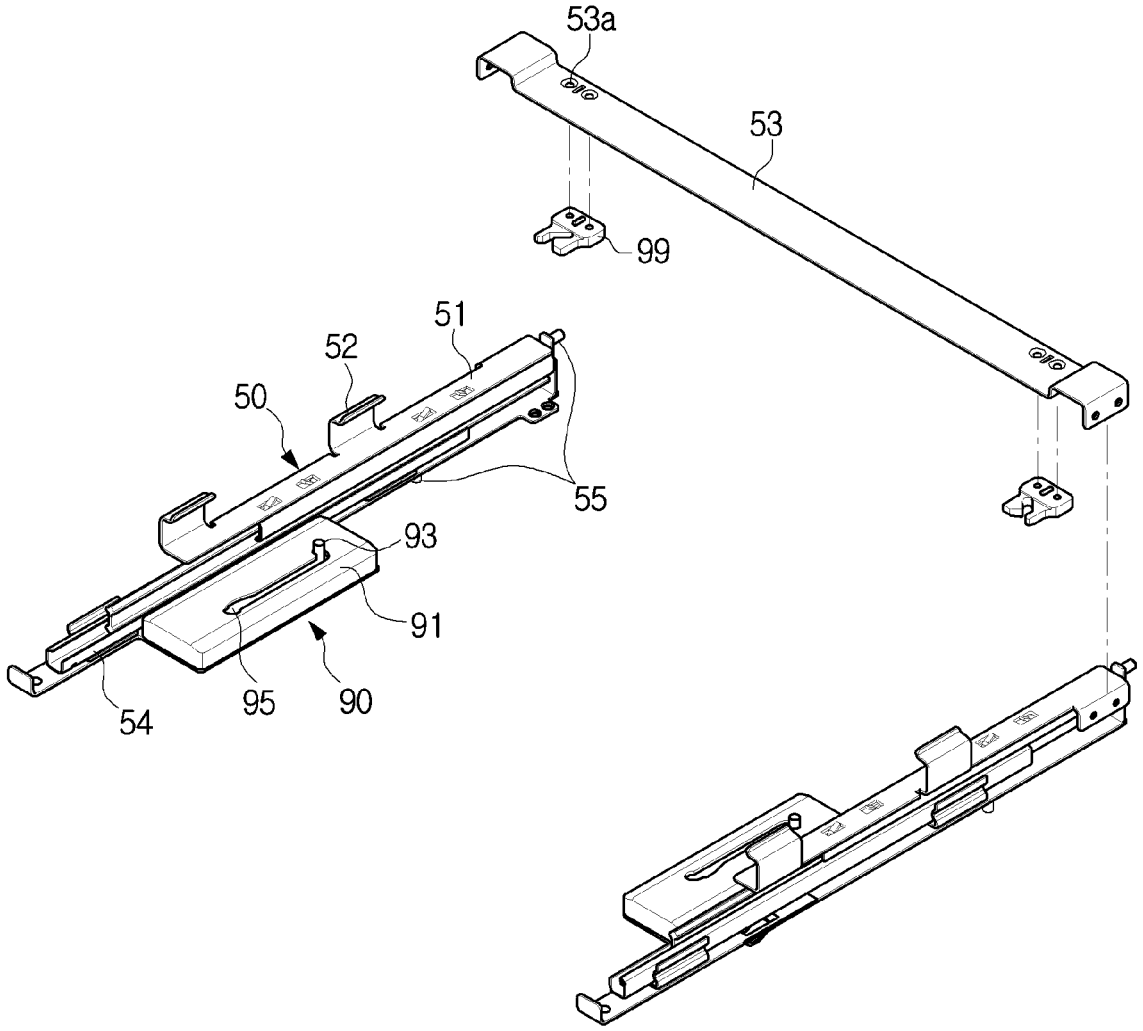
FIG. 17 illustrates the rail provided with the withdrawal assist device according to another embodiment of the present disclosure.
Figure 18:
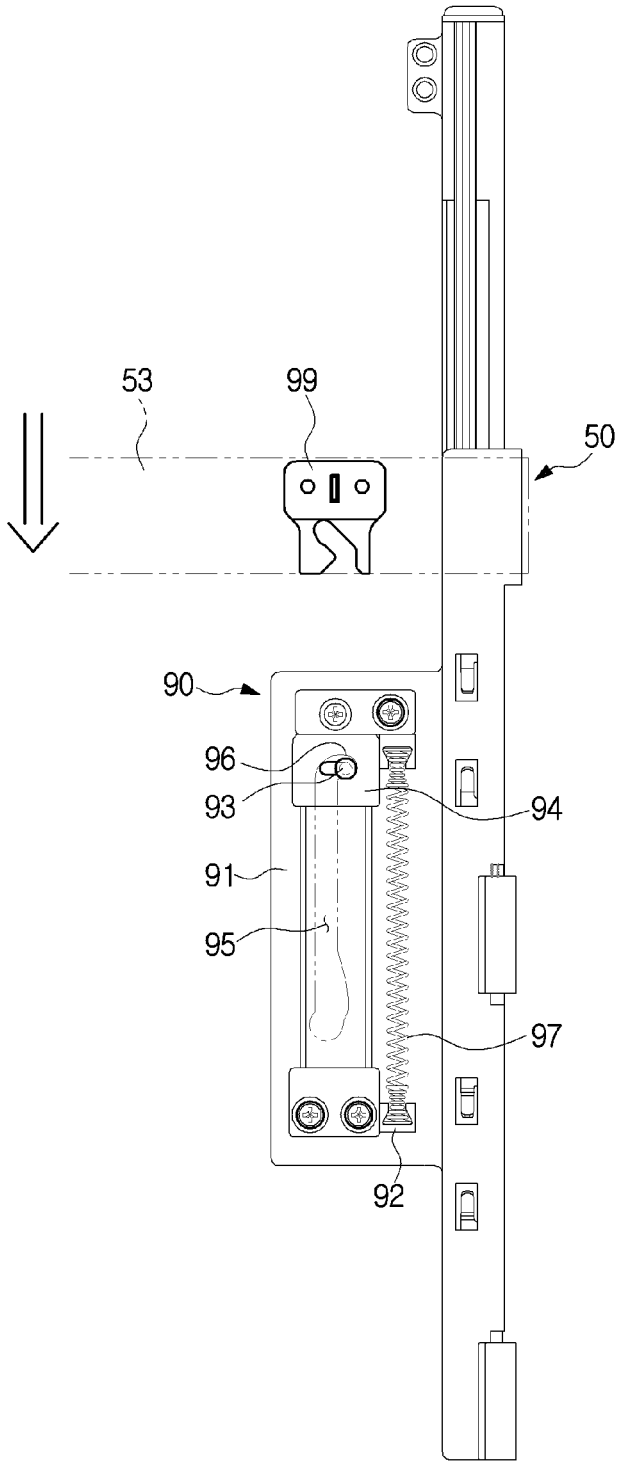
FIG. 18 illustrates an operation of the withdrawal assist device when a door of the oven is opened, according to another embodiment of the present disclosure.
Figure 19:
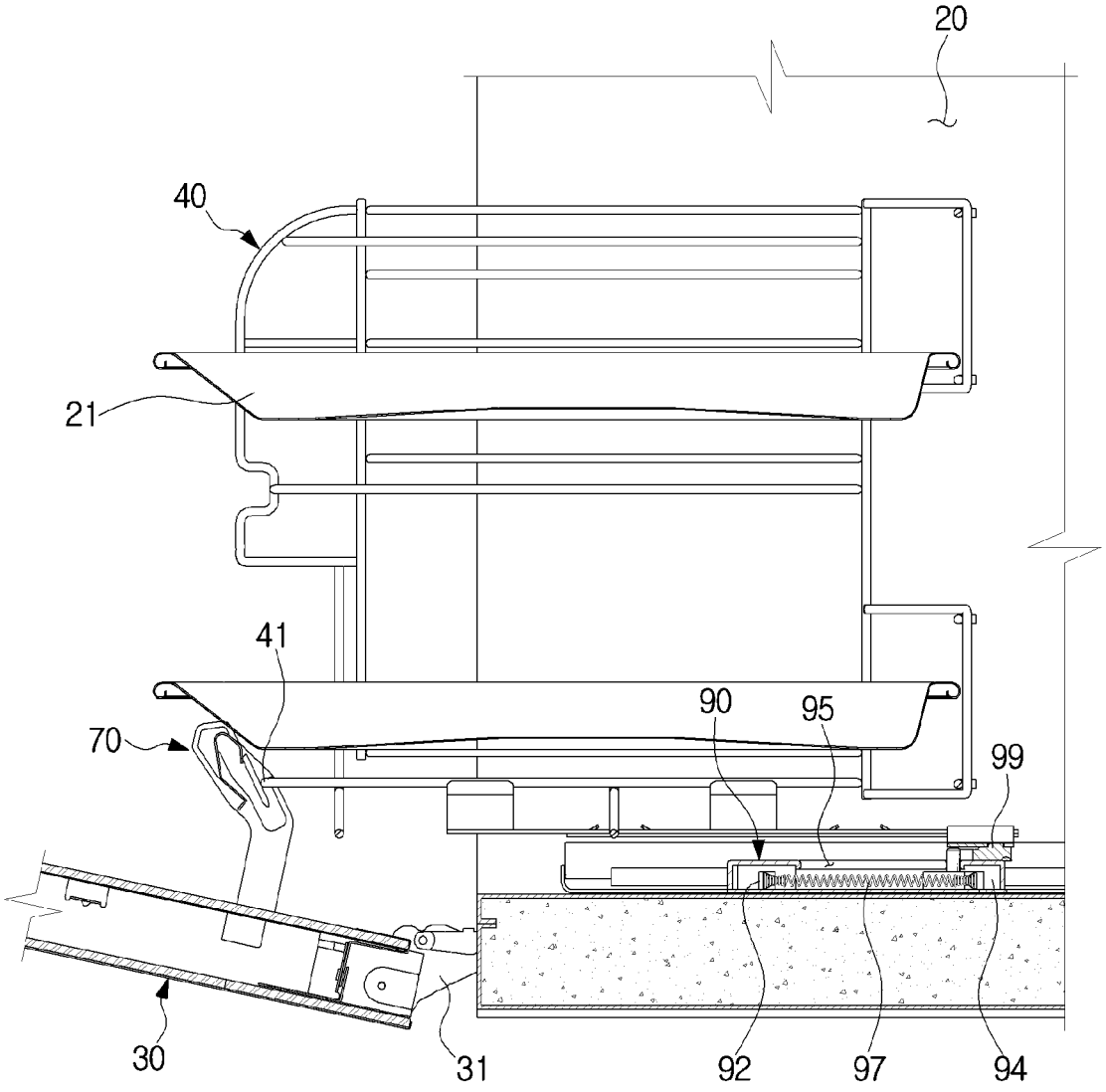
FIG. 19 illustrates an oven rack withdrawn from a cooking chamber when the door of the oven is opened, according to another embodiment of the present disclosure.
Figure 20:
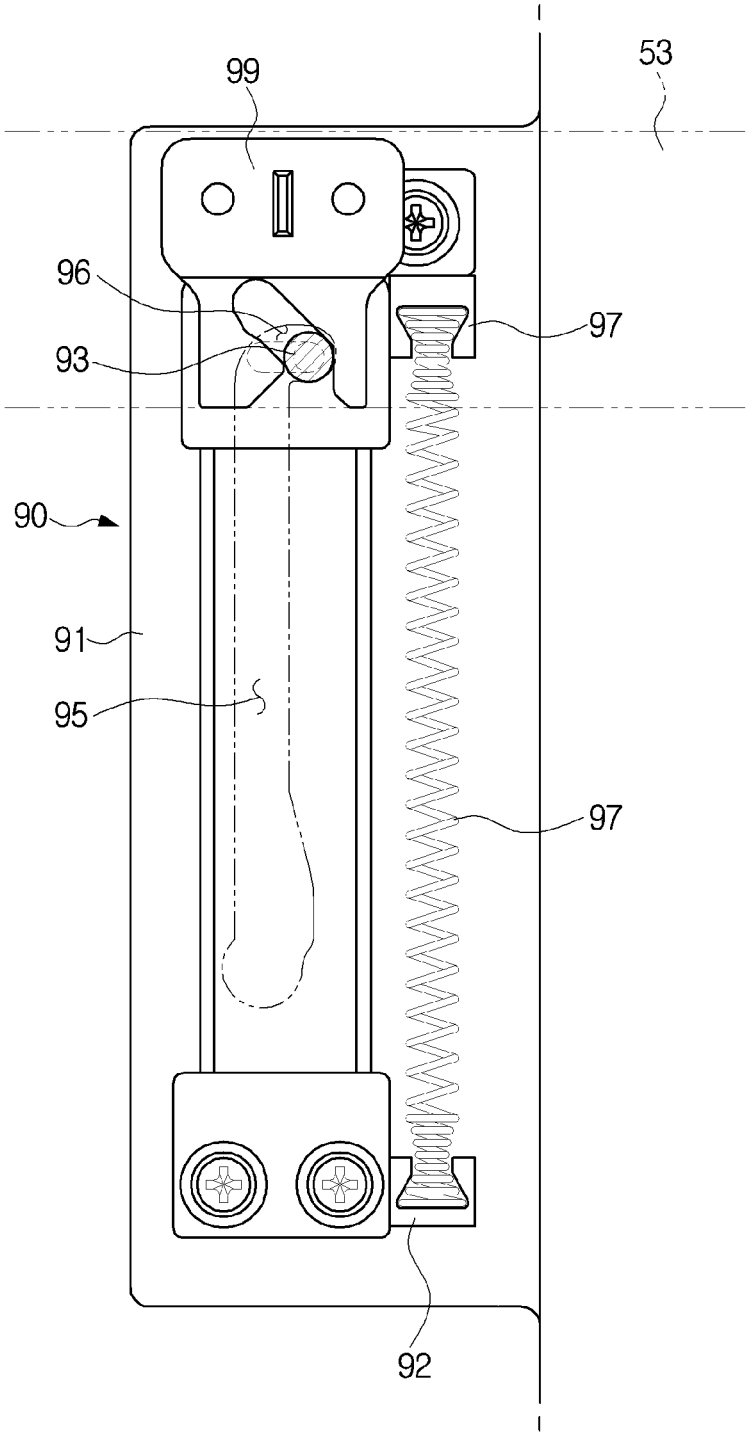
FIG. 20 illustrates that a trigger of the withdrawal assist device is in contact with a locking protrusion by opening the door of the oven, according to another embodiment of the present disclosure.
Figure 21:
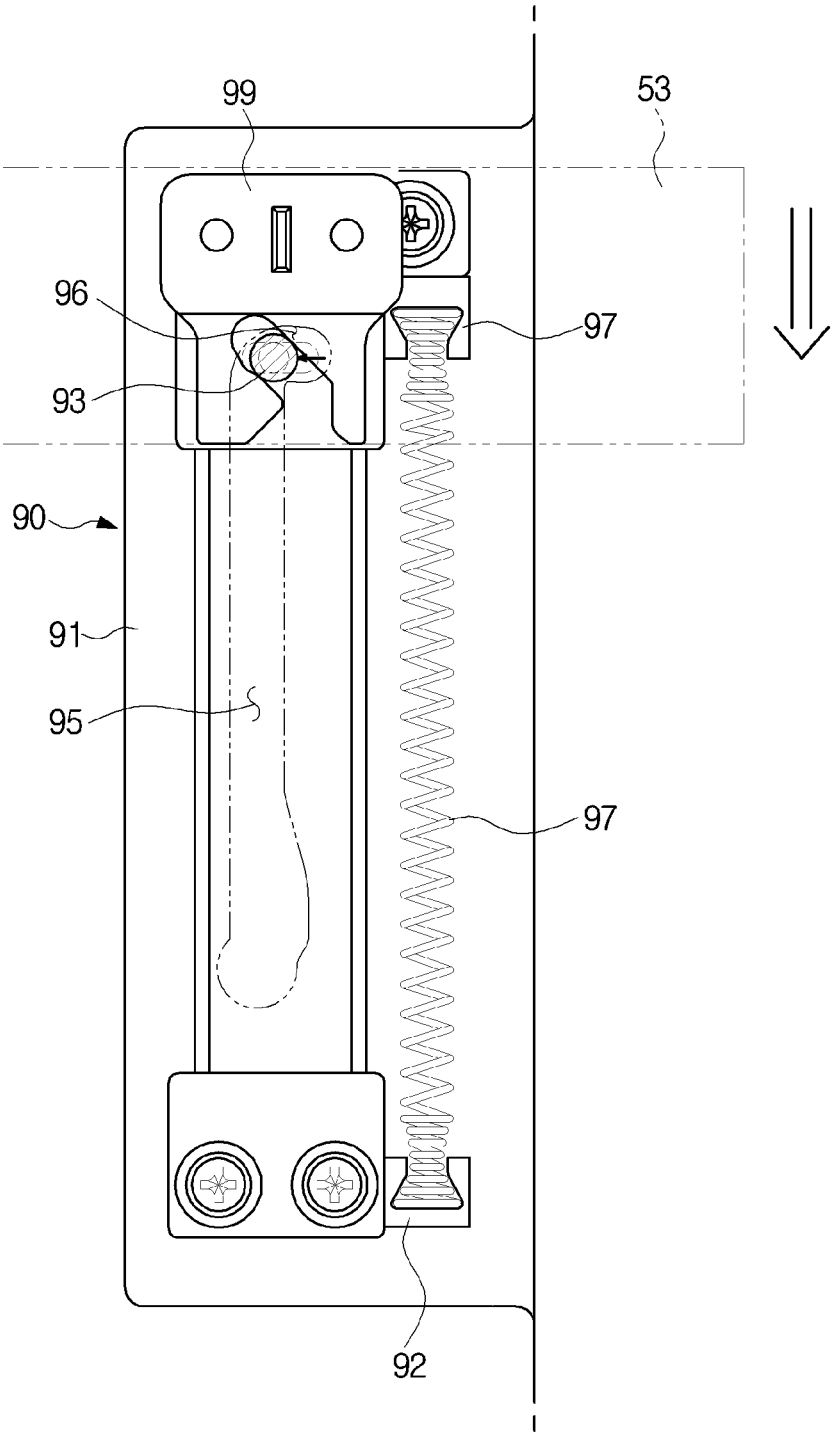
FIG. 21 illustrates that the locking protrusion is released from a locking groove by the trigger of the withdrawal assist device, according to another embodiment of the present disclosure.
Figure 22:
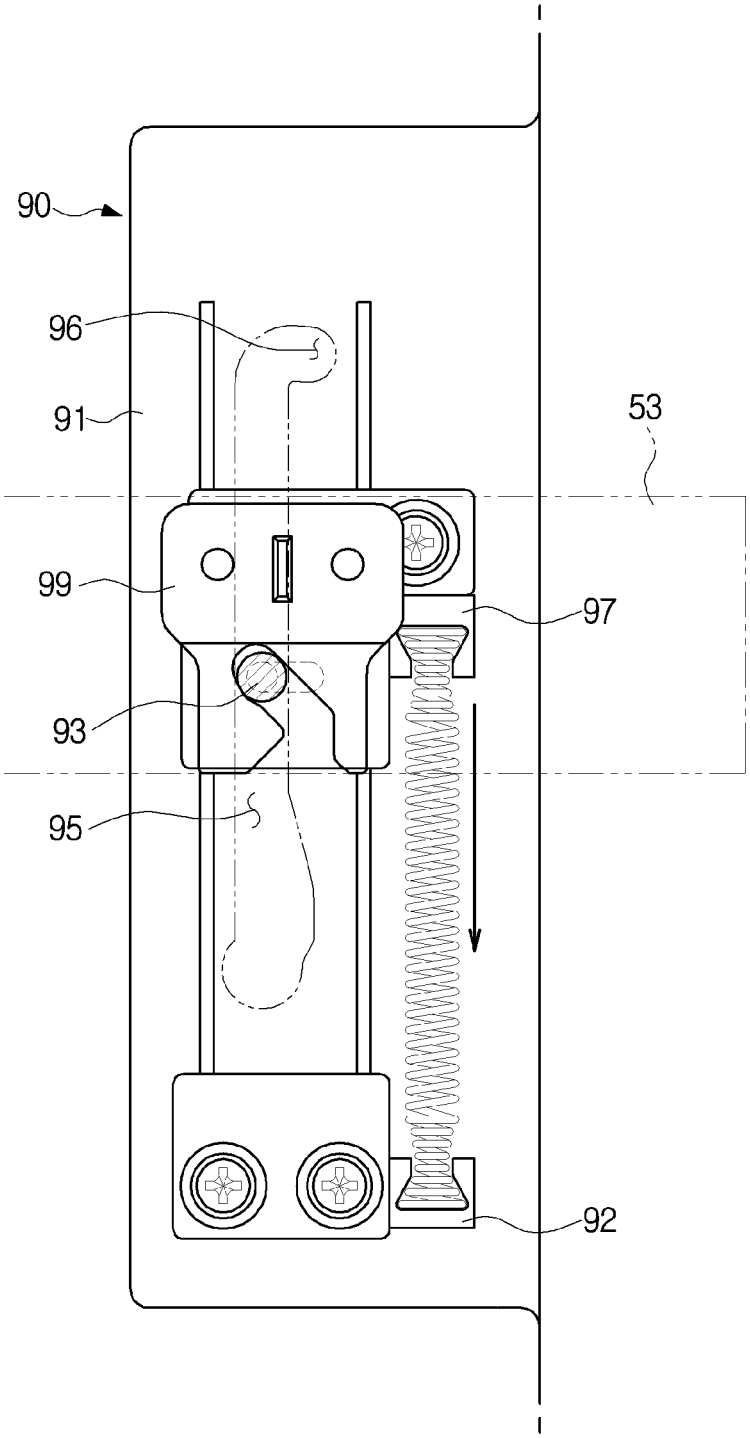
FIG. 22 illustrates that a stator is moved toward the front by the locking protrusion being released from the locking groove, according to another embodiment of the present disclosure.
Figure 23:
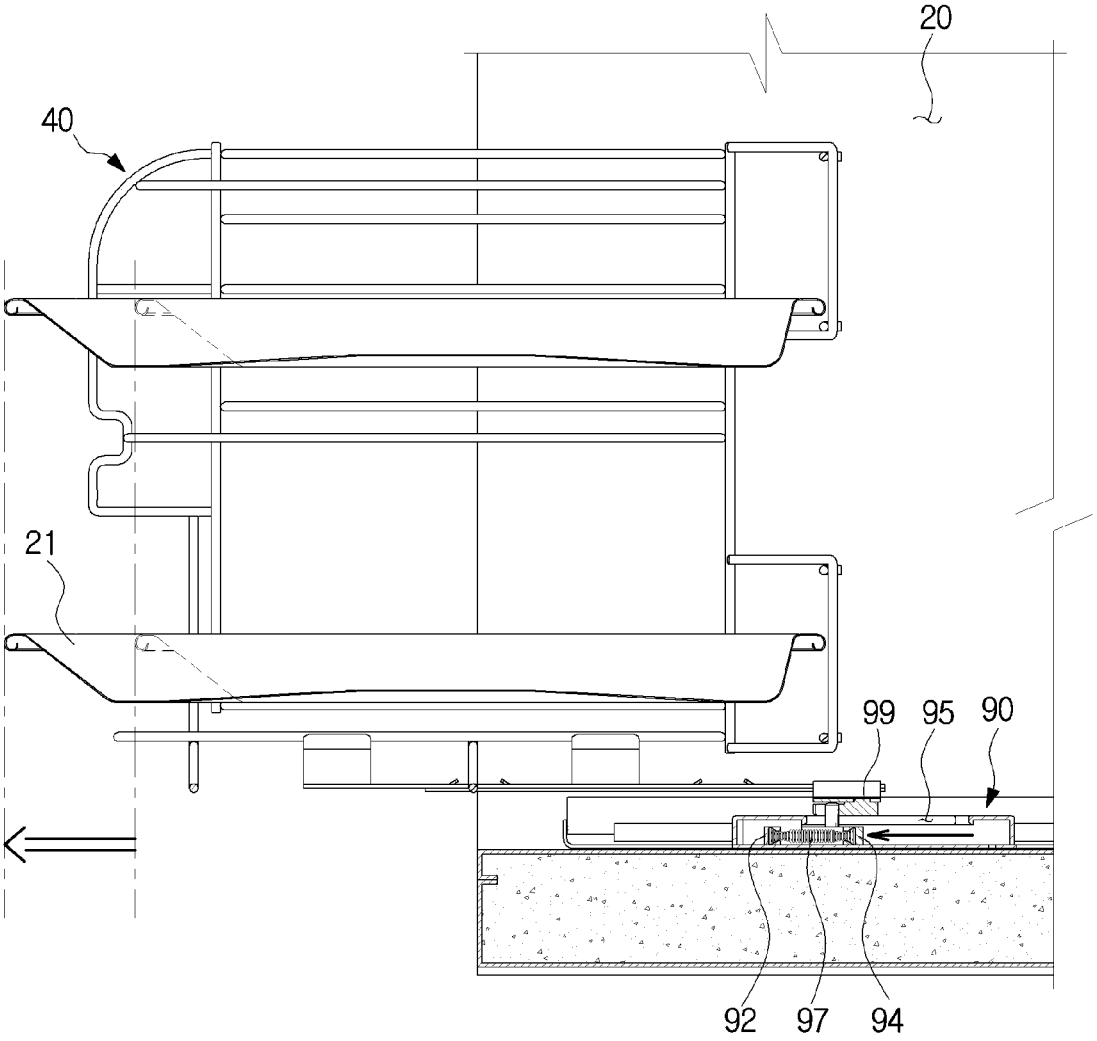
FIG. 23 illustrates that the oven rack is additionally withdrawn by a withdrawal assist device, according to another embodiment of the present disclosure.

FIG. 16 illustrates an oven in which a withdrawal assist device is provided on a rail, according to another embodiment of the present disclosure, FIG. 17 illustrates the rail provided with the withdrawal assist device according to another embodiment of the present disclosure, FIG. 18 illustrates an operation of the withdrawal assist device when a door of the oven is opened, according to another embodiment of the present disclosure, FIG. 19 illustrates an oven rack withdrawn from a cooking chamber when the door of the oven is opened, according to another embodiment of the present disclosure, FIG. 20 illustrates that a trigger of the withdrawal assist device is in contact with a locking protrusion by opening the door of the oven, according to another embodiment of the present disclosure, FIG. 21 illustrates that the locking protrusion is released from a locking groove by the trigger of the withdrawal assist device, according to another embodiment of the present disclosure, FIG. 22 illustrates that a stator is moved toward the front by the locking protrusion being released from the locking groove, according to another embodiment of the present disclosure, and FIG. 23 illustrates that the oven rack is additionally withdrawn by a withdrawal assist device, according to another embodiment of the present disclosure.

As illustrated in FIGS. 16 to 18, the oven includes a withdrawal assist device 90 for additionally withdrawing the oven rack 40 withdrawn to the outside of the cooking chamber 20 by the guide member 70 when the door 30 is opened, and the withdrawal assist device 90 may be provided on the rail 50.

The withdrawal assist device 90 may include a case 91 provided on the second rail 54 fixed to the inside of the cooking chamber 20, a stator 94 provided to linearly move inside the case 91 and having a locking protrusion 93, a guide rail 95 for guiding the locking protrusion 93, a locking groove 96 provided at the rear of the guide rail 95 to allow the locking protrusion 93 to be locked, a spring 97 provided inside the case 91 to apply an elastic force in a direction in which the oven rack 40 is withdrawn, and a trigger 99 coupled to the first rail 51 to be moved in the front-rear direction and releasing the locking protrusion 93 from the locking groove 96.

The case 91 is coupled to the second rail 54 fixed to the inside of the cooking chamber 20 and may form an outer appearance.

Because the stator 94 is provided inside the case 91 and the locking protrusion 93 provided at an upper portion of the stator 94 linearly moves along the guide rail 95, the stator 94 may be linearly moved inside the case 91.

When the door 30 is closed, the locking protrusion 93 may be locked to the locking groove 96 to fix the stator 94.

The guide rail 95 is formed to extend in the front-rear direction on the upper part of the case 91 and may guide the locking protrusion 93 to linearly move in the front-rear direction.

The locking groove 96 is provided at the rear of the guide rail 95 and may fix the locking protrusion 93 when the door 30 is closed.

The spring 97 is provided inside the case 91 and may be fixed to a spring fixing portion 92 having one side fixed to the stator 94 and the other side positioned opposite to the stator 94 inside the case 91.

The spring 97 may be in a state in which an elastic force is accumulated by being tensioned when the door 30 is closed, that is, when the oven rack 40 is located inside the cooking chamber 20.

When the locking protrusion 93 is released from the locking groove 96 by the trigger 99 in a state where the spring 97 accumulates the elastic force, the accumulated elastic force may be transmitted to the stator 94 so that the stator 94 may be moved to the front side.

When the stator 94 is moved forward, the spring 97 transmits the elastic force to the oven rack 40 while being compressed, so that the oven rack 40 may be additionally withdrawn from the inside of the cooking chamber 20, and A detailed description thereof will be given below.

The trigger 99 may be coupled to the reinforcement frame 53 of the first rail 51 moving in the front-rear direction, and the reinforcement frame 53 may include a trigger coupling portion 53*a* to which the trigger 99 is coupled.

The trigger 99 is moved in the front-rear direction together with the first rail 51, so that the locking protrusion 93 may be released from the locking groove 96.

As illustrated in FIG. 18, the trigger 99 of the withdrawal assist device 90 may be spaced apart from the locking protrusion 93 when the door is opened in a state of being closed.

Because the oven rack 40 is located inside the cooking chamber 20 when the door 30 starts to open, the first rail 51 coupled to the lower portion of the oven rack 40 may be maintained in a fixed state inside the cooking chamber 20.

Because the first rail 51 is maintained in a fixed state inside the cooking chamber 20, the trigger 99 coupled to the first rail 51 is also maintained in a fixed state, so that the trigger 99 may be spaced apart from the locking protrusion 93.

As illustrated in FIG. 19, when the door 30 is opened, the oven rack 40 is moved forward by the guide member 70 and may be withdrawn from the cooking chamber 20.

When the oven rack 40 is withdrawn from the cooking chamber 20, as illustrated in FIG. 20, the trigger 99 is moved forward together with the first rail 51 so that the trigger 99 may come into contact with the locking protrusion 93.

At this time, because the stator 94 is in a fixed state, the spring 97 inside the case 91 may be maintained in a state in which the elastic force is accumulated in a tensioned state.

When the door 30 is completely opened in a state where the trigger 99 is in contact with the locking protrusion 93, as illustrated in FIG. 21, the trigger 99 moves forward and may release the locking protrusion 93 from the locking groove 96.

When the locking protrusion 93 is released from the locking groove 96, as illustrated in FIG. 22, the locking protrusion 93 is moved toward the front side along the guide rail 95 by the elastic force of the spring 97, and the stator 94 provided with the locking protrusion 93 is also moved toward the front side.

When the stator 94 is moved, the trigger 99 in contact with the locking protrusion 93 also moves toward the front side, and the first rail 51 coupled with the trigger 99 may also move toward the front side.

Because the first rail 51 moves toward the front side, as illustrated in FIG. 23, the oven rack 40 in which a portion thereof is withdrawn from the cooking chamber 20 by opening of the door 30 may be additionally withdrawn to increase a distance in which the oven rack 40 is withdrawn from the cooking chamber 20.

When the withdrawal distance of the oven rack 40 increases, the user may more conveniently put out the shelf 21 supported on the oven rack 40 from the outside of the cooking chamber 20 and take out food or the like placed on the shelf 21.

While the present disclosure has been particularly described with reference to exemplary embodiments, it should be understood by those of skilled in the art that various changes in form and details may be made without departing from the spirit and scope of the present disclosure.

The invention claimed is:

1. An oven comprising:

a main body;

a cooking chamber provided inside the main body and having an open front side;

a door rotatably coupled to the main body to open and close the cooking chamber;

an oven rack provided inside the cooking chamber to be movable in a front-rear direction and supporting a plurality of shelves; and a guide member connected to the oven rack according to opening and closing of the door to guide the oven rack to be moved in the front-rear direction, and separated from the oven rack when the door is completely opened, wherein the guide member comprises an opening through which a portion of the oven rack is introduced into and withdrawn from the guide member.

2. The oven according to claim 1, wherein the guide member is provided in a pair to be coupled to each of left and right sides of a rear surface of the door, and the oven rack provided on each of opposite sides of the cooking chamber comprises a pair of connection protrusions protruding toward the pair of guide members to be connected to the pair of guide members.

3. The oven according to claim 2, wherein the guide member is configured such that one side thereof toward a connection protrusion is opened.

4. The oven according to claim 2, wherein the guide member further comprises a guide slot guiding a connection protrusion such that the oven rack is moved in the front-rear direction, and a plurality of guide walls forming the guide slot.

5. The oven according to claim 4, wherein the guide slot comprises a first guide slot guiding the connection protrusion introduced into the opening to move the oven rack toward the front side, and a second guide slot connected to the first guide slot and guiding the connection protrusion to be withdrawn to the opening.

6. The oven according to claim 5, wherein the guide member comprises an introducing portion connecting the opening to the first guide slot to allow the connection protrusion to be introduced into the first guide slot, and a withdrawing portion connecting the opening to the second guide slot to allow the connection protrusion to be withdrawn to the opening.

7. The oven according to claim 6, wherein a guide wall comprises a first guide wall in which the connection protrusion is positioned in a state where the door is closed, a second guide wall guiding the connection protrusion moving along the first guide slot such that the oven rack moves toward the front side when the door is opened, and a third guide wall guiding the connection protrusion to be withdrawn to the opening when the door is completely opened.

8. The oven according to claim 7, wherein the guide member comprises an opening and closing member to open and close the introducing portion, and the opening and closing member is provided as an elastic member.

9. The oven according to claim 8, wherein the opening and closing member opens the introducing portion such that the connection protrusion is introduced into the introducing portion when the door is closed, and closes the introducing portion when the connection protrusion is introduced into the introducing portion.

10. The oven according to claim 1, wherein a rail allowing the oven rack to be moved in the front-rear direction is detachably coupled to a lower portion of the oven rack, and the rail is detachably coupled to the inside of the cooking chamber.

11. The oven according to claim 10, wherein the rail comprises a plurality of bosses coupled to the cooking chamber, and the cooking chamber comprises a plurality of coupling grooves to which the plurality of bosses is detachably coupled.

12. The oven according to claim 1, wherein the oven rack is moved in the front-rear direction by a rail comprising a first rail coupled to a lower portion of the oven rack and a second rail coupled to the inside of the cooking chamber to guide the first rail to be moved in the front-rear direction, and a withdrawal assist device is provided on the rail to additionally withdraw the oven rack withdrawn when the door is opened.

13. The oven according to claim 12, wherein the withdrawal assist device comprises a case fixed to the second rail, a stator moving linearly inside the case and having a locking protrusion, a guide rail guiding the locking protrusion, a locking groove provided at a rear of the guide rail to lock the locking protrusion, a spring accumulating an elastic force when the door is closed and applying the elastic force in a direction in which the oven rack is withdrawn when the door is opened, and a trigger provided on the first rail to be moved in the front-rear direction such that the locking protrusion is released from the locking groove.

14. The oven according to claim 13, wherein when the oven rack is withdrawn by opening the door, the trigger is moved forward so that the locking protrusion is released from the locking groove, the locking protrusion is moved forward along the guide rail by being released from the locking groove, and when the stator to which one side of the spring is connected is moved forward together with the trigger, the oven rack is additionally withdrawn by the first rail moved forward together with the trigger.

* * * * *